US008245531B2

(12) United States Patent
Takahashi et al.

(10) Patent No.: US 8,245,531 B2
(45) Date of Patent: Aug. 21, 2012

(54) FLUID MACHINE AND REFRIGERATION CYCLE APPARATUS HAVING THE SAME

(75) Inventors: Yasufumi Takahashi, Osaka (JP); Hiroshi Hasegawa, Osaka (JP)

(73) Assignee: Panasonic Corporation, Osaka (JP)

( * ) Notice: Subject to any disclaimer, the term of this patent is extended or adjusted under 35 U.S.C. 154(b) by 343 days.

(21) Appl. No.: 12/598,663

(22) PCT Filed: Apr. 2, 2008

(86) PCT No.: PCT/JP2008/000853

§ 371 (c)(1),
(2), (4) Date: Nov. 3, 2009

(87) PCT Pub. No.: WO2008/139680

PCT Pub. Date: Nov. 20, 2008

(65) Prior Publication Data

US 2010/0132398 A1 Jun. 3, 2010

(30) Foreign Application Priority Data

May 16, 2007 (JP) ..... 2007-130101

(51) Int. Cl.
*F25B 41/00* (2006.01)
*F04C 29/04* (2006.01)

(52) U.S. Cl. ..... 62/510; 62/324.6; 417/205; 417/206

(58) Field of Classification Search ..... 417/199.1, 417/205, 206, 410.5, 423.5, 407; 62/87, 62/116, 324.6, 500, 510; 184/6.16
See application file for complete search history.

(56) References Cited

U.S. PATENT DOCUMENTS

| | | | | |
|---|---|---|---|---|
| 2007/0151266 | A1 * | 7/2007 | Yakumaru et al. | 62/197 |
| 2008/0232992 | A1 | 9/2008 | Okamoto et al. | |
| 2008/0310983 | A1 * | 12/2008 | Sakitani et al. | 418/55.1 |
| 2010/0089092 | A1 * | 4/2010 | Hasegawa et al. | 62/498 |

FOREIGN PATENT DOCUMENTS

| | | | |
|---|---|---|---|
| EP | 1 873 350 | A1 | 1/2008 |
| JP | 2005-098604 | A | 4/2005 |
| JP | 2005-299632 | A | 10/2005 |
| JP | 2006-266171 | A | 10/2006 |
| JP | 2007-315227 | A | 12/2007 |
| WO | WO 2006/103821 | A | 10/2006 |
| WO | WO 2007132649 | A1 * | 11/2007 |

* cited by examiner

*Primary Examiner* — Devon Kramer
*Assistant Examiner* — Dominick L Plakkoottam
(74) *Attorney, Agent, or Firm* — Hamre, Schumann, Mueller & Larson, P.C.

(57) ABSTRACT

A fluid machine (10) includes: a closed casing (11) having an oil reservoir (16) in its bottom portion; a main compression mechanism (3) supplied with oil contained in an upper portion (16*a*) of the oil reservoir; a rotation motor (8); a main compression mechanism side shaft (38) for coupling the main compression mechanism (3) and the rotation motor (8); a mechanical power recovery mechanism (5) disposed below the upper portion (16*a*) and recovering mechanical power from a working fluid; a sub-compression mechanism (2) disposed below the upper portion (16*a*); a mechanical power recovery shaft (16) for coupling the mechanical power recovery mechanism (5) and the sub-compression mechanism (2); and a heat-insulating structure (80) located between the upper portion (16*a*) and the mechanical power recovery mechanism (5) and restricting flow of oil between the upper portion (16*a*) of the oil reservoir (16) and a lower portion (16*b*) of the oil reservoir in which the mechanical power recovery mechanism (5) is provided.

23 Claims, 17 Drawing Sheets

FLUID MACHINE AND REFRIGERATION CYCLE APPARATUS HAVING THE SAME

TECHNICAL FIELD

The present invention relates to a fluid machine and a refrigeration cycle apparatus having the same.

BACKGROUND ART

As an example of a conventional fluid machine having an expansion mechanism and a compression mechanism, an expander-compressor unit is disclosed in JP 2005-299632 A. As shown in FIG. 18, an expander-compressor unit 130 described in JP 2005-299632 A includes a closed casing 120, a compression mechanism 121, a motor 122, and an expansion mechanism 123. The motor 122, the compression mechanism 121 and the expansion mechanism 123 are coupled to each other by a mechanical power recovery shaft 124. The expansion mechanism 123 recovers mechanical power from an expanding refrigerant. The mechanical power recovered by the expansion mechanism 123 is applied to the compression mechanism 121 via the mechanical power recovery shaft 124. Thereby, the power consumption of the motor 122 for driving the compression mechanism 121 is reduced. As a result, the coefficient of performance (COP) of a refrigeration cycle apparatus using this expander-compressor unit 130 is improved.

In the expander-compressor unit 130, a bottom portion 125 of the closed casing 120 is used as an oil reservoir for containing refrigerating machine oil. The refrigerating machine oil contained in the bottom portion 125 is pumped up to the upper part of the closed casing 120 by an oil pump 126 disposed at the lower end portion of the mechanical power recovery shaft 124. The refrigerating machine oil pumped up by the oil pump 126 is supplied, through an oil supply passage 127 formed inside the mechanical power recovery shaft 124, to the compression mechanism 121 and the expansion mechanism 123. Thereby, lubrication and sealing of the sliding parts of the compression mechanism 121 and the expansion mechanism 123 are ensured.

An oil return passage 128 is formed at an upper part of the expansion mechanism 123. One end of the oil return passage 128 is connected to the oil supply passage 127 in the mechanical power recovery shaft 124. The other end of the oil return passage 128 opens downwardly to the space below the expansion mechanism 123. Generally, in order to ensure the reliability of the expansion mechanism 123, an excess amount of refrigerating machine oil is supplied to the expansion mechanism 123. The excess refrigerating machine oil is returned to the oil reservoir through the above-mentioned oil return passage 128.

The amount of refrigerating machine oil mixed in the refrigerant and discharged from the compression mechanism 121 together with the refrigerant is different from the amount of refrigerating machine oil mixed in the refrigerant and discharged from the expansion mechanism 123. Therefore, in the case where the compression mechanism 121 and the expansion mechanism 123 are accommodated in separate closed casings, an excess or shortage of refrigerating machine oil to be contained may occur in the closed casing in which the compression mechanism 121 is accommodated or in the closed casing in which the expansion mechanism 123 is accommodated.

In contrast, in the expander-compressor unit 130, the expansion mechanism 123 and the compression mechanism 121 are disposed in the same closed casing 120, in which they share the common oil reservoir. Therefore, in the expander-compressor unit 130, there arises no problem such as the above-mentioned excess or shortage of oil.

However, like the expander-compressor unit 130, in the case where the expansion mechanism 123 and the compression mechanism 121 are accommodated in the same closed casing 120, heat transfer occurs easily between the expansion mechanism 123 and the compression mechanism 121. When heat transfer occurs between the expansion mechanism 123 and the compression mechanism 121, there arises a problem that the COP of the expander-compressor unit 130 decreases.

DISCLOSURE OF THE INVENTION

The present invention has been devised in view of the problems described above, and an object thereof is to suppress heat transfer between an expansion mechanism and a compression mechanism in a fluid machine in which the expansion mechanism and the compression mechanism are accommodated in the same closed casing.

A first fluid machine according to the present invention includes: a closed casing; a main compression mechanism; a rotation motor; a main compression mechanism side shaft; a mechanical power recovery mechanism; a sub-compression mechanism; a mechanical power recovery shaft; and at least one heat-insulating structure. The closed casing has, in its bottom portion, an oil reservoir for containing oil. The main compression mechanism is disposed in the closed casing and supplied with oil contained in an upper portion of the oil reservoir, and compresses a working fluid. The rotation motor is disposed above the oil reservoir in the closed casing, and includes a rotor and a stator. The main compression mechanism side shaft couples the main compression mechanism and the rotation motor so that the main compression mechanism is driven by the rotation motor. The mechanical power recovery mechanism is disposed below the upper portion in the oil reservoir, and recovers mechanical power from the working fluid by carrying out at least a suction process in which the working fluid is drawn and a discharge process in which the drawn working fluid is discharged. The sub-compression mechanism is disposed below the upper portion in the oil reservoir, and compresses the working fluid and discharges the compressed working fluid toward the main compression mechanism. The mechanical power recovery shaft couples the mechanical power recovery mechanism and the sub-compression mechanism so that the sub-compression mechanism is driven by the mechanical power recovered by the mechanical power recovery mechanism. The at least one heat-insulating structure is located between the upper portion and the mechanical power recovery mechanism so as to restrict flow of oil between the upper portion of the oil reservoir and a lower portion of the oil reservoir in which the mechanical power recovery mechanism is provided.

In the first fluid machine according to the present invention, oil contained in the upper portion of the oil reservoir is supplied to the main compression mechanism. Thereby, an oil circulation cycle for allowing the oil to flow through the main compression mechanism is formed between the upper portion of the oil reservoir and the main compression mechanism. As a result, the temperature of the oil contained in the upper portion of the oil reservoir is increased to a relatively high temperature, while the temperature of the oil contained in the lower portion of the oil reservoir remains relatively low. Therefore, the mechanical power recovery mechanism disposed in the lower portion of the oil reservoir is maintained at a relatively low temperature. In addition, the heat-insulating structure restricts the flow of the oil between the upper portion of the oil reservoir and the lower portion of the oil reservoir. Thereby, the relatively high temperature oil contained in the upper portion of the oil reservoir is inhibited from flowing into the lower portion of the oil reservoir, and the relatively low temperature oil contained in the lower portion of the oil reservoir is inhibited from flowing into the upper portion of the oil reservoir. As a result, heat transfer between the main compression mechanism and the mechanical power recovery mechanism can be suppressed effectively.

A second fluid machine according to the present invention includes: a closed casing; a main compression mechanism; a rotation motor; a main compression mechanism side shaft; a mechanical power recovery mechanism; a sub-compression mechanism; and a mechanical power recovery shaft. The closed casing has, in its bottom portion, an oil reservoir for containing oil. The main compression mechanism is disposed in the closed casing and supplied with oil contained in an upper portion of the oil reservoir, and compresses a working fluid. The rotation motor is disposed above the oil reservoir in the closed casing, and includes a rotor and a stator. The main compression mechanism side shaft couples the main compression mechanism and the rotation motor so that the main compression mechanism is driven by the rotation motor. The mechanical power recovery mechanism is disposed below the upper portion in the oil reservoir, and recovers mechanical power from the working fluid by carrying out at least a suction process in which the working fluid is drawn and a discharge process in which the drawn working fluid is discharged. The sub-compression mechanism is disposed below the upper portion in the oil reservoir, and compresses the working fluid and discharges the compressed working fluid toward the main compression mechanism. The mechanical power recovery shaft couples the mechanical power recovery mechanism and the sub-compression mechanism so that the sub-compression mechanism is driven by the mechanical power recovered by the mechanical power recovery mechanism.

In the second fluid machine according to the present invention, oil contained in the upper portion of the oil reservoir is supplied to the main compression mechanism. Thereby, an oil circulation cycle for allowing the oil to flow through the main compression mechanism is formed between the upper portion of the oil reservoir and the main compression mechanism. As a result, the temperature of the oil contained in the upper portion of the oil reservoir is increased to a relatively high temperature, while the temperature of the oil contained in the lower portion of the oil reservoir remains relatively low. Therefore, the mechanical power recovery mechanism disposed in the lower portion of the oil reservoir is maintained at a relatively low temperature. As a result, heat transfer between the main compression mechanism and the mechanical power recovery mechanism can be suppressed effectively.

A refrigeration cycle apparatus according to the present invention includes the first fluid machine or the second fluid machine according to the present invention as described above.

The present invention makes it possible to suppress heat transfer between the expansion mechanism and the compression mechanism in the fluid machine in which the expansion mechanism and the compression mechanism are accommodated in the same closed casing.

BEST MODE FOR CARRYING OUT THE INVENTION

First Embodiment

Hereinafter, embodiments of the present invention will be described with reference to a refrigeration cycle apparatus 1 shown in FIG. 1. It should be noted that the refrigeration cycle apparatus 1 is merely an example, and the present invention is not limited to the refrigeration cycle apparatus 1 described below.

<General Configuration of Refrigeration Cycle Apparatus 1>

Figure 1:
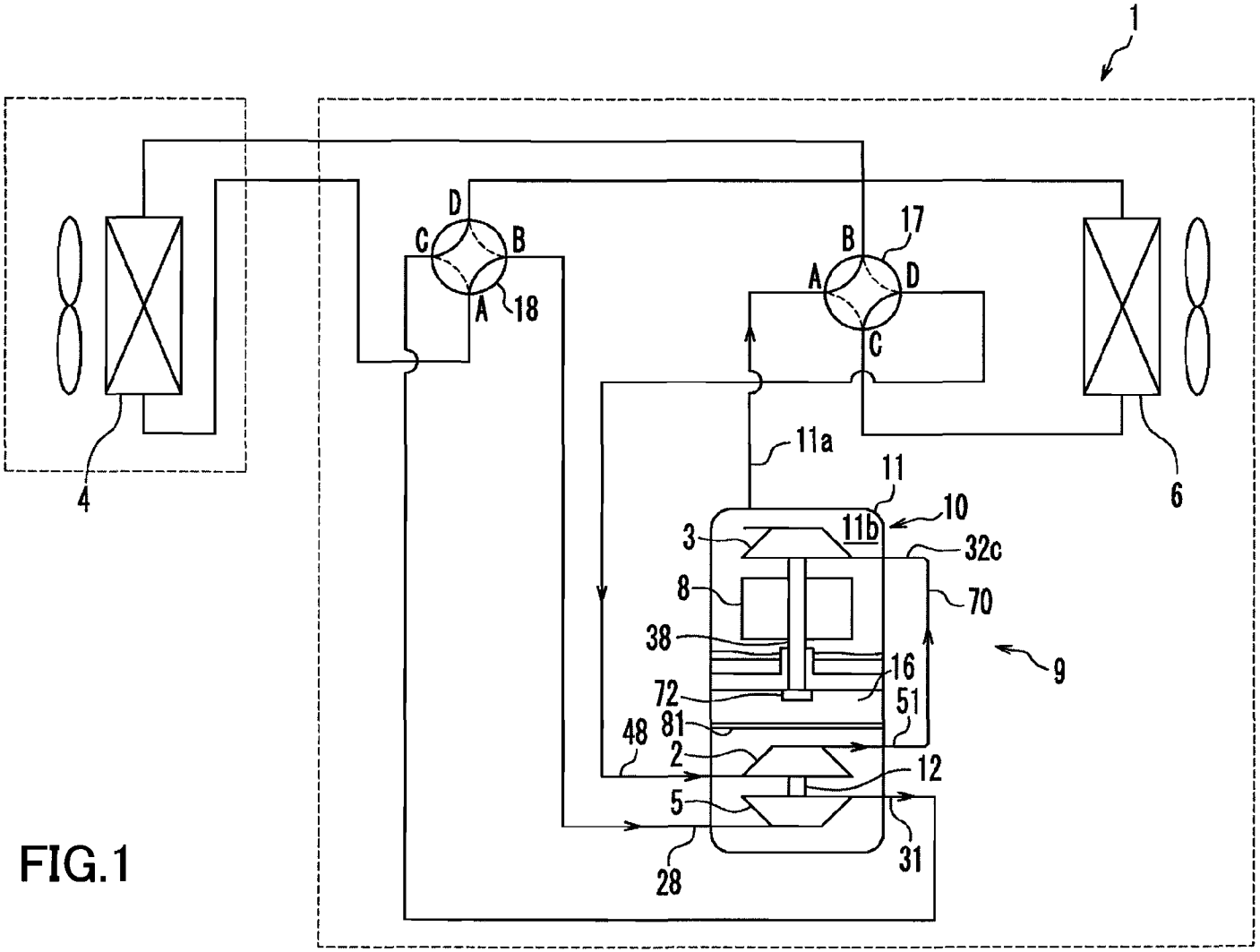
FIG. 1 is a configuration diagram of a refrigeration cycle apparatus according to a first embodiment.

As shown in FIG. 1, the refrigeration cycle apparatus 1 includes a refrigerant circuit 9 provided with two four-way valves 17 and 18. The refrigerant circuit 9 includes a main compression mechanism 3, a first heat exchanger 4, a mechanical power recovery mechanism 5, a second heat exchanger 6, and a sub-compression mechanism 2. The refrigerant circuit 9 is filled with a refrigerant, as a working fluid, that is brought into a supercritical pressure state on the high pressure side of the refrigerant circuit 9. Specifically, the refrigerant circuit 9 is filled with carbon dioxide as a refrigerant.

It should be noted that in the present invention, the refrigerant is not limited to carbon dioxide. For example, the refrigerant circuit 9 may be filled with a refrigerant that is not brought into a supercritical pressure state on the high pressure side. Specifically, the refrigerant circuit 9 may be filled with a fluorocarbon refrigerant.

The refrigeration cycle apparatus 1 is used in a state where A-B and C-D are connected in each of the four-way valves 17 and 18, or a state where A-C and B-D are connected in each of the four-way valves 17 and 18. First, the state where A-B and C-D are connected in each of the four-way valves 17 and 18 will be described.

—The Case where A-B and C-D are Connected in Each of the Four-Way Valves 17 and 18—

First, a refrigerant compressed by the main compression mechanism 3 is discharged first to an interior space 11*b* of a closed casing 11. The refrigerant discharged to the interior space 11*b* is discharged to the refrigerant circuit 9 through a discharge pipe 11*a* fixed to the closed casing 11.

The discharged refrigerant is supplied to the first heat exchanger 4 via the four-way valve 17. In this case, the first heat exchanger 4 serves as a radiator.

The refrigerant is supplied from the first heat exchanger 4 to the mechanical power recovery mechanism 5 via the four-way valve 18 and through a suction pipe 28. The mechanical power recovery mechanism 5 expands the refrigerant and recovers mechanical power from the expanding refrigerant by carrying out a suction process in which the refrigerant is drawn and a discharge process in which the drawn refrigerant is discharged.

The refrigerant discharged through a discharge pipe 31 of the mechanical power recovery mechanism 5 is supplied to the second heat exchanger 6 via the four-way valve 18. In this case, the second heat exchanger 6 serves as an evaporator. That is, the second heat exchanger 6 evaporates the refrigerant.

The refrigerant is supplied from the second heat exchanger 6 to the sub-compression mechanism 2 via the four-way valve 17 and through a suction pipe 48. Here, the sub-compression mechanism 2 is connected to the mechanical power recovery mechanism 5 by a mechanical power recovery shaft 12. This mechanical power recovery shaft 12 transfers the mechanical power recovered by the mechanical power recovery mechanism 5 to the sub-compression mechanism 2. The sub-compression mechanism 2 is driven by the mechanical power thus transferred, and carries out a process for drawing the refrigerant and a process for discharging the refrigerant. Thereby, the sub-compression mechanism 2 compresses the refrigerant preliminarily (increases the pressure of the refrigerant). Thus, in the sub-compression mechanism 2, the energy recovered from the refrigerant by the mechanical power recovery mechanism 5 is imparted again to the refrigerant. The refrigerant discharged from the sub-compression mechanism 2 is supplied to the main compression mechanism 3 via a connecting pipe 70.

—The Case where A-C and B-D are Connected in Each of the Four-Way Valves 17 and 18—

On the other hand, in the case where A-C and B-D are connected in each of the four-way valves 17 and 18, the refrigerant compressed by the main compression mechanism 3 is supplied to the second heat exchanger 6 via the four-way valve 17. In this case, the second heat exchanger 6 serves as a radiator.

The refrigerant is supplied from the second heat exchanger 6 to the mechanical power recovery mechanism 5 via the four-way valve 18. In this mechanical power recovery mechanism 5, the refrigerant is expanded. The refrigerant is supplied from the mechanical power recovery mechanism 5 to the first heat exchanger 4 via the four-way valve 18. In this case, the first heat exchanger 4 serves as an evaporator. That is, the refrigerant is evaporated by the first heat exchanger 4.

The refrigerant is supplied from the first heat exchanger 4 to the sub-compression mechanism 2 via the four-way valve 17. The refrigerant supplied to the sub-compression mechanism 2 is compressed preliminarily by the sub-compression mechanism 2. After that, the refrigerant is supplied to the main compression mechanism 3 via the connecting pipe 70.

<Fluid Machine 10>

Figure 2:
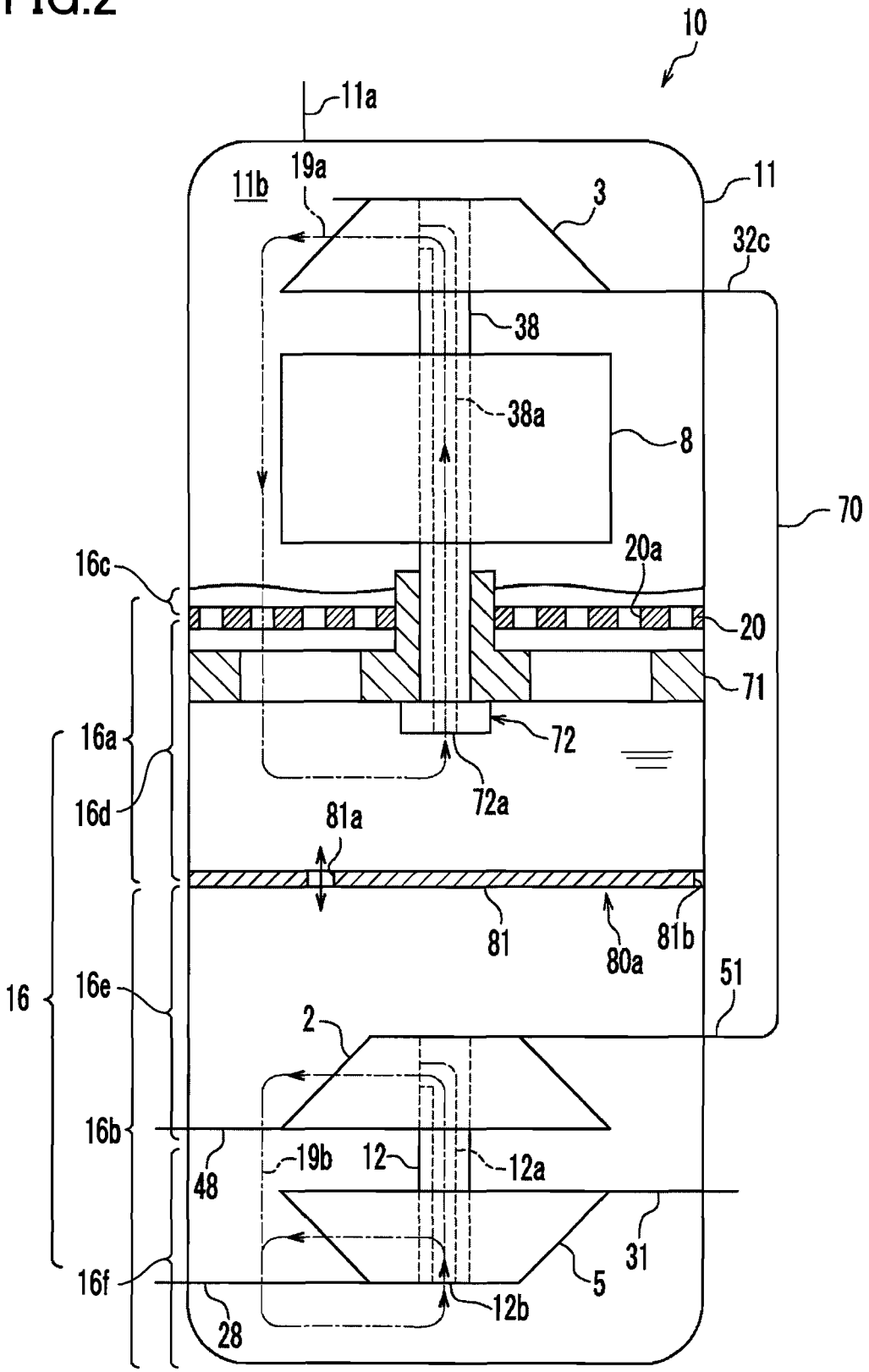
FIG. 2 is a schematic configuration diagram of the fluid machine in the first embodiment.

As shown in FIGS. 1 and 2, the fluid machine 10 includes an approximately cylindrical closed casing 11, a main compression mechanism 3, a rotation motor 8, a mechanical power recovery mechanism 5, a sub-compression mechanism 2, and an oil agitation suppressing plate 20. The closed casing 11 has, in its bottom portion, an oil reservoir 16 in which refrigerating machine oil can be contained.

(Oil Agitation Suppressing Plate 20)

The oil agitation suppressing plate (plate member) 20 is disposed in the oil reservoir 16. Specifically, the oil agitation suppressing plate 20 is disposed in the upper portion 16*a* of the oil reservoir 16. The upper portion 16*a* of the oil reservoir 16 is partitioned by this oil agitation suppressing plate 20 into a first upper portion 16*c* (surface portion) located on a top surface portion of the oil reservoir and a second upper portion 16*d* located below the first upper portion. The oil agitation suppressing plate 20 has one or more holes 20*a*. The first upper portion 16*c* and the second upper portion 16*d* communicate with each other through these one or more holes 20*a*. Thereby, refrigerating machine oil can flow between the first upper portion 16*c* and the second upper portion 16*d*.

(Main Compression Mechanism 3)

The main compression mechanism 3 and the rotation motor 8 are disposed above the oil reservoir 16 in the closed casing 11. Specifically, the main compression mechanism 3 is disposed at a position farthest from the oil reservoir 16. The rotation motor 8 is disposed below the main compression mechanism 3. The rotation motor 8 and the main compression mechanism 3 are coupled to each other by a main compression mechanism side shaft 38. The power of the rotation motor 8 is transferred to the main compression mechanism 3 via the main compression mechanism side shaft 38, and thereby the main compression mechanism 3 is driven. The main compression mechanism 3 discharges the compressed refrigerant that is a working fluid to the interior space 11*b* of the closed casing 11. The relatively high pressure refrigerant thus discharged first stays in this interior space 11*b*, and then is discharged to the refrigerant circuit 9 through the discharge pipe 11*a* fixed to the closed casing 11.

It should be noted that the main compression mechanism 3 is not particularly limited as long as it can compress the refrigerant. For example, the main compression mechanism 3 may be a scroll-type compression mechanism. The main compression mechanism 3 also may be a rotary-type compression mechanism.

As shown in FIG. 2, the main compression mechanism side shaft 38 extends downwardly below the rotation motor 8. The main compression mechanism side shaft 38 is supported rotatably at its lower end portion by a sub-bearing member 71 fixed to the closed casing 11. The lower end portion of the main compression mechanism side shaft 38 is located in the upper portion 16*a* of the oil reservoir 16. Specifically, the lower end portion of the main compression mechanism side shaft 38 is located in the second upper portion 16*d* of the oil reservoir 16.

At the lower end portion of the main compression mechanism side shaft 38, an oil pump 72 having a suction port 72*a* at its lower portion is mounted. This oil pump 72 draws the refrigerating machine oil in the second upper portion 16*d* of the oil reservoir 16. As shown in FIG. 2, the drawn refrigerating machine oil is supplied to the main compression mechanism 3 through an oil supply passage 38*a* formed inside the main compression mechanism side shaft 38 so as to extend in the axial direction of the main compression mechanism side shaft 38. Thereby, the sliding parts of the main compression mechanism 3 are lubricated and sealed. The refrigerating machine oil supplied to the main compression mechanism 3 is returned again to the upper portion 16*a* of the oil reservoir 16 from the main compression mechanism 3.

It should be noted that the type of the oil pump 72 is not particularly limited. For example, the oil pump 72 may be a trochoid pump. The detailed structure of the trochoid pump will be described in the fourth embodiment below.

(Mechanical Power Recovery Mechanism 5 and Sub-Compression Mechanism 2)

In the oil reservoir 16, the mechanical power recovery mechanism 5 and the sub-compression mechanism 2 are disposed. Specifically, the sub-compression mechanism 2 is disposed in the lower portion 16*b* located below the upper portion 16*a*, and more specifically, it is disposed in a first lower portion 16*e* (which may be referred to as a middle portion) located in the upper part of the lower portion 16*b*. On the other hand, the mechanical power recovery mechanism 5 is disposed in a second lower portion (a narrowly-defined lower portion) 16*f* located in the lower part of the lower portion 16*b* (that is, located below the first lower portion 16*e*). The mechanical power recovery mechanism 5 is disposed below the sub-compression mechanism 2. In other words, the sub-compression mechanism 2 is disposed at a position relatively close to the main compression mechanism 3. The mechanical power recovery mechanism 5 is disposed at a position relatively far from the main compression mechanism 3.

The mechanical power recovery mechanism 5 and the sub-compression mechanism 2 are coupled to each other by a mechanical power recovery shaft 12, which is different from the main compression mechanism side shaft 38 coupled to the main compression mechanism 3. This mechanical power recovery shaft 12 transfers the mechanical power recovered by the mechanical power recovery mechanism 5 to the sub-compression mechanism 2, and thereby the sub-compression mechanism 2 is driven.

The mechanical power recovery mechanism 5 recovers mechanical power from a refrigerant by carrying out at least a suction process in which the refrigerant is drawn and a discharge process in which the drawn refrigerant is discharged. Specifically, the mechanical power recovery mechanism 5 can be constituted by, for example, an expansion mechanism or a fluid pressure motor. The "expansion mechanism" here is a mechanism that carries out a suction process in which a refrigerant is drawn, an expansion process in which the drawn refrigerant is expanded in an isolated working chamber, and a discharge process in which the expanded refrigerant is discharged. On the other hand, the "fluid pressure motor" carries out, in a substantially continuous manner, a suction process in which a refrigerant is drawn and a discharge process in which the drawn refrigerant is discharged. That is, the fluid pressure motor does not carry out an expansion process in which a refrigerant is expanded in an isolated working chamber.

In the case where the mechanical power recovery mechanism 5 is a fluid pressure motor, the discharge process starts in the mechanical power recovery mechanism 5. Specifically, the working chamber communicates with the low pressure side of the refrigerant circuit 9, and thereby the refrigerant expands. Since a relatively high pressure refrigerant flows into the mechanical power recovery mechanism 5 from the high pressure side of the refrigerant circuit 9, and the refrigerant in the working chamber is drawn to the low pressure side of the refrigerant circuit 9 in the discharge process, the mechanical power recovery mechanism 5 is rotated. Thereby, the mechanical power recovery mechanism 5 recovers mechanical power from the refrigerant. In short, the mechanical power recovery mechanism 5 recovers the energy liberated when the refrigerant shifts from the high pressure side to the low pressure side of the refrigerant circuit 9.

The sub-compression mechanism 2 may carry out a process in which a refrigerant is drawn, a compression process in which the drawn refrigerant is compressed in an isolated working chamber, and a process in which the compressed refrigerant is discharged. The sub-compression mechanism 2 also may carry out, in a substantially continuous manner, a process in which a refrigerant is drawn and a process in which the drawn refrigerant is discharged.

(Oil Supply Passage 12*a*)

An oil supply passage 12*a* is formed inside the mechanical power recovery shaft 12. The oil supply passage 12*a* has an oil suction port 12*b* formed at the lower end portion of the mechanical power recovery shaft 12. Refrigerating machine oil is drawn from this oil suction port 12*b*. The drawn refrigerating machine oil is supplied to the mechanical power recovery mechanism 5 and the sub-compression mechanism 2 through the oil supply passage 12*a*. Thereby, the sliding parts of the mechanical power recovery mechanism 5 and the sub-compression mechanism 2 are lubricated and sealed.

The oil supply passage 12*a* may be formed spirally on the outer peripheral surface of the mechanical power recovery shaft 12 so as to draw the refrigerating machine oil automatically with the rotation of the mechanical power recovery shaft 12. An oil pump for supplying refrigerating machine oil to the oil supply passage 12*a* also may be provided. In FIG. 2, the oil supply passage 12*a* is illustrated as a line segment extending in the axial direction of the mechanical power recovery shaft 12. This is a schematic view of the oil supply passage 12*a*, and does not show the specific shape of the oil supply passage 12*a*.

(Connecting Pipe 70)

As shown in FIG. 2, a connecting pipe 70, at least a part of which is located outside the closed casing 11, is disposed in the fluid machine 10. This connecting pipe 70 connects a discharge pipe 51 of the sub-compression mechanism 2 and a suction pipe 32*c* of the main compression mechanism 3. Thereby, a refrigerant, which has been compressed preliminarily in the sub-compression mechanism 2, is supplied to the main compression mechanism 3.

(Heat-Insulating Structure 80*a*)

In the first embodiment, as shown in FIG. 2, a heat-insulating structure 80*a* is disposed between the main compression mechanism 3 and the mechanical power recovery mechanism 5. Specifically, the heat-insulating structure 80*a* is disposed between the upper portion 16*a* and the lower portion 16*b*. The heat-insulating structure 80*a* is disposed separately from the sub-compression mechanism 2 and the mechanical power recovery mechanism 5.

The heat-insulating structure 80*a* includes a plate member 81 disposed between the upper portion 16*a* and the lower portion 16*b* to separate the upper portion 16*a* and the lower portion 16*b*. The plate member 81 is a separate component from the mechanical power recovery mechanism 5 and the sub-compression mechanism 2.

One or more openings 81*a* are formed in the plate member 81. A gap 81*b* is formed between the plate member 81 and the inner wall of the closed casing 11. The refrigerating machine oil can flow between the upper portion 16*a* and the lower portion 16*b* through these openings 81*a* and the gap 81*b*.

The size of the openings 81*a* is not particularly limited as long as the refrigerating machine oil in the upper portion 16*a* and the refrigerating machine oil in the lower portion 16*b* can flow through the openings 81*a*.

The material of the plate member 81 is not particularly limited. Preferably, the material of the plate member 81 has a low thermal conductivity. For example, it is preferable that the material of the plate member 81 has a lower thermal conductivity than that of the refrigerating machine oil.

<Functions and Effects>

As described above, in the first embodiment, the refrigerating machine oil in the upper portion 16*a* of the oil reservoir 16 is supplied to the main compression mechanism 3, and the refrigerating machine oil supplied to the main compression mechanism 3 is returned to the upper portion 16*a* from the main compression mechanism 3. As shown in FIG. 2, an oil circulation path 19*a* passing through the main compression mechanism 3 is formed between the portion located above the oil reservoir 16 in the interior space 11*b* and the upper portion 16*a*. Therefore, relatively high temperature refrigerating machine oil that passes through the relatively high temperature main compression mechanism 3 is contained in the upper portion 16*a*. Accordingly, the relatively high temperature refrigerating machine oil is inhibited from flowing into the lower portion 16*b*. As a result, heat transfer between the main compression mechanism 3 and the mechanical power recovery mechanism 5 via the refrigerating machine oil in the oil reservoir 16 is suppressed. As a result, the COP of the refrigeration cycle apparatus 1 can be improved.

To the contrary, for example, in the case where the oil pump 72 is disposed in the second lower portion 16*f* of the oil reservoir 16, the oil circulation path 19*a* passing through the main compression mechanism 3 is formed extending to the second lower portion 16*f*. Therefore, the relatively high temperature refrigerating machine oil also flows into the second lower portion 16*f*. As a result, the temperature of the mechanical power recovery mechanism 5 increases. On the other hand, the refrigerating machine oil cooled by the mechanical power recovery mechanism 5 is supplied to the main compression mechanism 3. Therefore, the temperature of the main compression mechanism 3 decreases. In the case where the refrigerating machine oil in the lower portion 16*b*, especially in the second lower portion 16*f*, is supplied to the main compression mechanism 3, a relatively large amount of heat is transferred between the main compression mechanism 3 and the mechanical power recovery mechanism 5. Accordingly, the COP of the refrigeration cycle apparatus decreases.

When the oil circulation path 19*a* passing only through the upper portion 16*a* of the oil reservoir 16 is formed as in the first embodiment, heat transfer between the main compression mechanism 3 and the mechanical power recovery mechanism 5 is suppressed, and thereby the COP of the refrigeration cycle apparatus 1 also is improved.

In the first embodiment, the medium temperature sub-compression mechanism 2 is disposed in the first lower portion 16*e* located between the upper portion 16*a* in which the highest temperature refrigerating machine oil is present and the lowest temperature second lower portion 16*f* in which the mechanical power recovery mechanism 5 is provided. That is, the highest temperature upper portion 16*a* is located at the uppermost position, and the temperature decreases gradually in the downward direction. Therefore, for example, unlike the case where the temperature of the second lower portion 16*f* is high, the convection of the refrigerating machine oil in the oil reservoir 16 is suppressed. Furthermore, the sub-compression mechanism 2 is disposed closer to the relatively high temperature main compression mechanism 3, while the mechanical power recovery mechanism 5 is disposed at a position relatively far from the main compression mechanism 3. Therefore, the sub-compression mechanism 2 disposed between the main compression mechanism 3 and the mechanical power recovery mechanism 5 serves as a thermal barrier, which suppresses effectively heat transfer between the main compression mechanism 3 and the mechanical power recovery mechanism 5. Accordingly, the COP of the refrigeration cycle apparatus 1 is improved further.

Moreover, in the first embodiment, the rotation motor 8 is disposed between the main compression mechanism 3 and the sub-compression mechanism 2. Therefore, the mechanical power recovery mechanism 5 is located further from the main compression mechanism 3. As a result, heat exchange between the main compression mechanism 3 and the mechanical power recovery mechanism 5 is suppressed more effectively.

In the first embodiment, the heat-insulating structure 80*a* is disposed between the upper portion 16*a* and the lower portion 16*b*. Thereby, the flow of the refrigerating machine oil is restricted effectively between the upper portion 16*a* and the lower portion 16*b*. Accordingly, the relatively high temperature refrigerating machine oil in the upper portion 16*a* is inhibited from flowing into the lower portion 16*b*. The relatively low temperature refrigerating machine oil in the lower portion 16*b* is inhibited from flowing into the upper portion 16*b*. As a result, heat exchange between the main compression mechanism 3 and the mechanical power recovery mechanism 5 is suppressed. Accordingly, the COP of the refrigeration cycle apparatus 1 is improved further.

Only from the viewpoint of inhibiting more effectively the flow of the refrigerating machine oil between the upper portion 16*a* and the lower portion 16*b*, it is preferable that the plate member 81 does not have any openings 81*a* and is mounted such that the flow of the refrigerating machine oil through the gap between the plate member 81 and the inner wall of the closed casing 11 is blocked. With such a configuration, no flow of the refrigerating machine oil substantially occurs between the upper portion 16*a* and the lower portion 16*b*.

In this case, however, the upper portion 16*a* and the lower portion 16*b* are separated completely from each other. Therefore, during the operation of the refrigeration cycle apparatus 1, the refrigerating machine oil in the upper portion 16*a* or the refrigerating machine oil in the lower portion 16*b* runs short, which may cause insufficient lubrication or sealing of the main compression mechanism 3, or the mechanical power recovery mechanism 5 and the sub-compression mechanism 2. As a result, the reliability of the refrigeration cycle apparatus 1 decreases. Therefore, it is preferable that the plate member 81 restricts, to some extent, the flow of the refrigerant between the upper portion 16*a* and the lower portion 16*b* but does not separate completely the upper portion 16*a* and the lower portion 16*b*. Specifically, it is preferable that the opening 81*a* is formed in the plate member 81 and/or the gap 81*b* having a size enough to allow the refrigerating machine oil to flow between the upper portion 16*a* and the lower portion 16*b* is formed between the plate member 81 and the inner wall of the closed casing 11. Thereby, it is possible to achieve both the high reliability and high COP of the refrigeration cycle apparatus 1.

In the first embodiment, the heat-insulating structure 80*a* is constituted by the plate member 81, which is a separate component from the mechanical power recovery mechanism 5 and the sub-compression mechanism 2. The heat-insulating structure 80*a* is disposed separately from the mechanical power recovery mechanism 5 and the sub-compression mechanism 2. In other words, the layer of the refrigerating machine oil is present between the heat-insulating structure 80*a*, and the mechanical power recovery mechanism 5 and the sub-compression mechanism 2. Therefore, heat is prevented from being transmitted from the heat-insulating structure 80*a* directly to the mechanical power recovery mechanism 5 and the sub-compression mechanism 2. As a result, heat exchange between the main compression mechanism 3 and the mechanical power recovery mechanism 5 is suppressed further, and thereby the COP of the refrigeration cycle apparatus 1 is improved further.

From the viewpoint of suppressing heat exchange between the upper portion 16*a* and the lower portion 16*b* more effectively, it is especially preferable that the material of the plate member 81 has a lower thermal conductivity than that of the refrigerating machine oil.

In the first embodiment, the refrigerating machine oil contained in the second lower portion 16*f* located farthest from the relatively high temperature upper portion 16*a* is drawn from the oil suction port 12*b* and supplied to the mechanical power recovery mechanism 5. Thereby, it is possible to suppress the interference between the oil circulation path 19*a* passing through the main compression mechanism 3 and the oil circulation path 19*b* passing through the mechanical power recovery mechanism 5 effectively. Accordingly, the heat transfer between the main compression mechanism 3 and the mechanical power recovery mechanism 5 is suppressed further, and the COP of the refrigeration cycle apparatus 1 also is improved further.

In the closed casing 11, the rotation motor 8 serving as a rotation motor is disposed. Therefore, when the refrigeration cycle apparatus 1 is driven, the rotation motor 8 is rotated, which generates an air flow in the closed casing 11. Thereby, for example, when the oil agitation suppressing plate 20 is not present, the refrigerating machine oil contained in the oil reservoir 16 is agitated by the air flow generated with the rotation of the rotation motor 8. In this case, the refrigerating machine oil in the upper portion 16*a* and the refrigerating machine oil in the lower portion 16*b* are mixed together. That is, the relatively high temperature refrigerating machine oil flows from the upper portion 16*a* into the lower portion 16*b*, while the relatively low temperature refrigerating oil flows from the lower portion 16*b* into the upper portion 16*a*. As a result, heat transfer between the main compression mechanism 3 and the mechanical power recovery mechanism 5 is promoted, and thereby the COP of the refrigeration cycle apparatus 1 decreases.

In contrast, in the first embodiment, the oil agitation suppressing plate 20 is disposed in the upper portion 16*a*. Therefore, the refrigerating machine oil in the first upper portion 16*c* is agitated by the air flow generated with the rotation of the rotation motor 8, but the agitation of the refrigerating machine oil in the second upper portion 16*d* is suppressed. Accordingly, the flow of the refrigerating machine oil in the second upper portion 16*d* and the lower portion 16*b* is inhibited. In other words, the refrigerating machine oil in the second upper portion 16*d* and the lower portion 16*b* is almost at rest. The flow of the relatively low temperature refrigerating machine oil into the upper portion 16*a* and the flow of the relatively high temperature refrigerating machine oil into the lower portion 16*b* are inhibited. As a result, heat transfer between the main compression mechanism 3 and the mechanical power recovery mechanism 5 is suppressed particularly, and the COP of the refrigeration cycle apparatus 1 also is improved particularly.

In the first embodiment, an example where the oil pump 72 is located in the second upper portion 16*d* has been described. In other words, the example where the refrigerating machine oil in the second upper portion 16*d* is supplied to the main compression mechanism 3 has been described. It should be noted, however, that the present invention is not limited to this configuration. For example, the oil pump 72 may be disposed in the first upper portion 16*c*. In other words, the refrigerating machine oil in the first upper portion 16*c* may be supplied to the main compression mechanism 3.

For example, it is conceivable that the sub-compression mechanism 2 is not disposed but the mechanical power recovery shaft 12 for the mechanical power recovery mechanism 5 is connected to the main compression mechanism side shaft 38 for the main compression mechanism 3 so as to recover mechanical power. However, the temperature of the main compression mechanism 3 is very high compared with that of the mechanical power recovery mechanism 5. Therefore, when the main compression mechanism 3 and the mechanical power recovery mechanism 5 are connected, heat exchange occurs between the main compression mechanism 3 and the mechanical power recovery mechanism 5. As a result, the COP of the refrigeration cycle apparatus 1 decreases. On the other hand, the temperature of the sub-compression mechanism 2 is not so high as that of the main compression mechanism 3. Therefore, heat exchange that occurs in the case where the sub-compression mechanism 2 and the mechanical power recovery mechanism 5 are connected is not so significant as heat exchange that occurs in the case where the mechanical power recovery mechanism 5 and the main compression mechanism 3 are connected. Accordingly, in the case where the sub-compression mechanism 2 is provided separately from the main compression mechanism 3 and the sub-compression mechanism 2 and the mechanical power recovery mechanism 5 are connected to recover mechanical power, as in the first embodiment, a decrease in the COP of the refrigeration cycle apparatus 1 can be suppressed. In other words, the energy efficiency of the refrigeration cycle apparatus 1 can be increased.

In the first embodiment, the main compression mechanism side shaft 38 for the main compression mechanism 3 is a separate component from the mechanical power recovery shaft 12 for the mechanical power recovery mechanism 5 and the sub-compression mechanism 2. Therefore, the degree of freedom in designing the main compression mechanism 3, the mechanical power recovery mechanism 5 and the sub-compression mechanism 2 increases further. As a result, the cost can be reduced further.

This configuration eliminates the need to arrange the main compression mechanism side shaft 38 and the mechanical power recovery shaft 12 so that the axis of the main compression mechanism side shaft 38 and the axis of the mechanical power recovery shaft 12 lie on the same straight line. Therefore, the degree of freedom in arranging the main compression mechanism 3, and the mechanical power recovery mechanism 5 and the sub-compression mechanism 2 also increases. As a result, the degree of freedom in designing the fluid machine 10 increases. In some cases, the fluid machine 10 can be made more compact.

In the first embodiment, the main compression mechanism 3, the sub-compression mechanism 2 and the mechanical power recovery mechanism 5 are accommodated in the same closed casing 11. Therefore, the number of closed casings can be reduced, compared with, for example, the case where the sub-compression mechanism 2 and the mechanical power recovery mechanism 5 are accommodated in a closed casing separate from the closed casing 11 in which the main compression mechanism 3 is accommodated. As a result, the refrigeration cycle apparatus 1 can be made compact.

The sub-compression mechanism 2 and the mechanical power recovery mechanism 5 are disposed in the oil reservoir 16 in which the refrigerating machine oil to be supplied to the main compression mechanism 3 is contained. With this configuration, only one oil reservoir can serve as both an oil reservoir for supplying refrigerating machine oil to the main compression mechanism 3, and an oil reservoir for supplying refrigerating machine oil to the sub-compression mechanism 2 and the mechanical power recovery mechanism 5.

For example, in the case where an oil reservoir is provided for the sub-compression mechanism 2 and the mechanical power recovery mechanism 5 separately from the oil reservoir 16 for the main compression mechanism 3, the refrigerating machine oil flowing into the refrigerant circuit 9 from one of the oil reservoirs returns to the other oil reservoir. As a result, the amount of refrigerating machine oil contained in the one oil reservoir may be reduced. In such a case, the main compression mechanism 3, or the sub-compression mechanism 2 and the mechanical power recovery mechanism 5 may not be lubricated or sealed sufficiently.

In contrast, in the case where the main compression mechanism 3, and the sub-compression mechanism 2 and the mechanical power recovery mechanism 5 share one oil reservoir, as in the first embodiment, even if the refrigerating machine oil flows out the oil reservoir 16 into the refrigerant circuit 9, the flowed refrigerating machine oil passes through the refrigerant circuit 9 and then returns again to the oil reservoir 16. Therefore, a decrease in the amount of refrigerating machine oil contained in the oil reservoir 16 can be suppressed. As a result, the refrigerating machine oil can be supplied stably to both the main compression mechanism 3, and the sub-compression mechanism 2 and the mechanical power recovery mechanism 5. Accordingly, the sliding parts of the main compression mechanism 3, and the sub-compression mechanism 2 and the mechanical power recovery mechanism 5 are lubricated appropriately, and as a result, the reliability of the refrigeration cycle apparatus 1 is improved. In addition, the clearances in the main compression mechanism 3, and the sub-compression mechanism 2 and the mechanical power recovery mechanism 5 can be sealed with high reliability. Accordingly, the operation efficiency of the refrigeration cycle apparatus 1 can be increased.

In the first embodiment, the refrigerant in the main compression mechanism 3 is discharged first in the closed casing 11, and contained in the closed casing 11 for a while, during which the refrigerating machine oil mixed into the refrigerant is separated from the refrigerant. The separated refrigerating machine oil is returned again to the oil reservoir 16. The refrigerating machine oil mixed into the refrigerant is separated from the refrigerant in the closed casing 11 and returned to the oil reservoir 16, as described above. Therefore, a decrease in the amount of refrigerating machine oil contained in the oil reservoir 16 is suppressed more effectively. As a result, the refrigerating machine oil can be supplied more stably to the main compression mechanism 3, the sub-compression mechanism 2 and the mechanical power recovery mechanism 5.

In addition, with such a configuration in which the refrigerant compressed by the main compression mechanism 3 is discharged first in the closed casing 11, the pressure in the closed casing 11 can be maintained at a relatively high level. Thereby, the refrigerating machine oil can be supplied easily to the main compression mechanism 3 through the oil supply passage 38*a* formed inside the main compression mechanism side shaft 38. Likewise, the penetration of the refrigerating machine oil into the sub-compression mechanism 2 and the mechanical power recovery mechanism 5 also is facilitated. As a result, the refrigerating machine oil can be supplied more reliably to the main compression mechanism 3, and the sub-compression mechanism 2 and the mechanical power recovery mechanism 5. Thereby, the reliability of the refrigeration cycle apparatus 1 is improved further, and the operation efficiency of the refrigeration cycle apparatus 1 is increased further.

Unlike the case where the oil reservoir for the sub-compression mechanism 2 and the mechanical power recovery mechanism 5 is provided separately from the oil reservoir for the main compression mechanism 3, the shared use of only one oil reservoir by the main compression mechanism 3, and the sub-compression mechanism 2 and the mechanical power recovery mechanism 5 eliminates the need for a special mechanism such as an oil equalizing pipe for equalizing the amounts of refrigerating machine oil contained in each of the oil reservoirs. Therefore, the configuration of the refrigeration cycle apparatus 1 is simplified. The manufacturing cost of the refrigeration cycle apparatus 1 also is reduced.

Furthermore, the use of the connecting pipe 70 disposed outside the closed casing 11 allows the suction pipe 32*c* and the discharge pipe 51 to be connected easily to each other, regardless of the configuration of the main compression mechanism 3 and the sub-compression mechanism 2. In addition, since this configuration eliminates substantially the need for a design change in the arrangement in the closed casing 11, the main compression mechanism 3, the sub-compression mechanism 2 and the like can be used easily in common with another refrigeration cycle apparatus 1.

Second Embodiment

Figure 3:
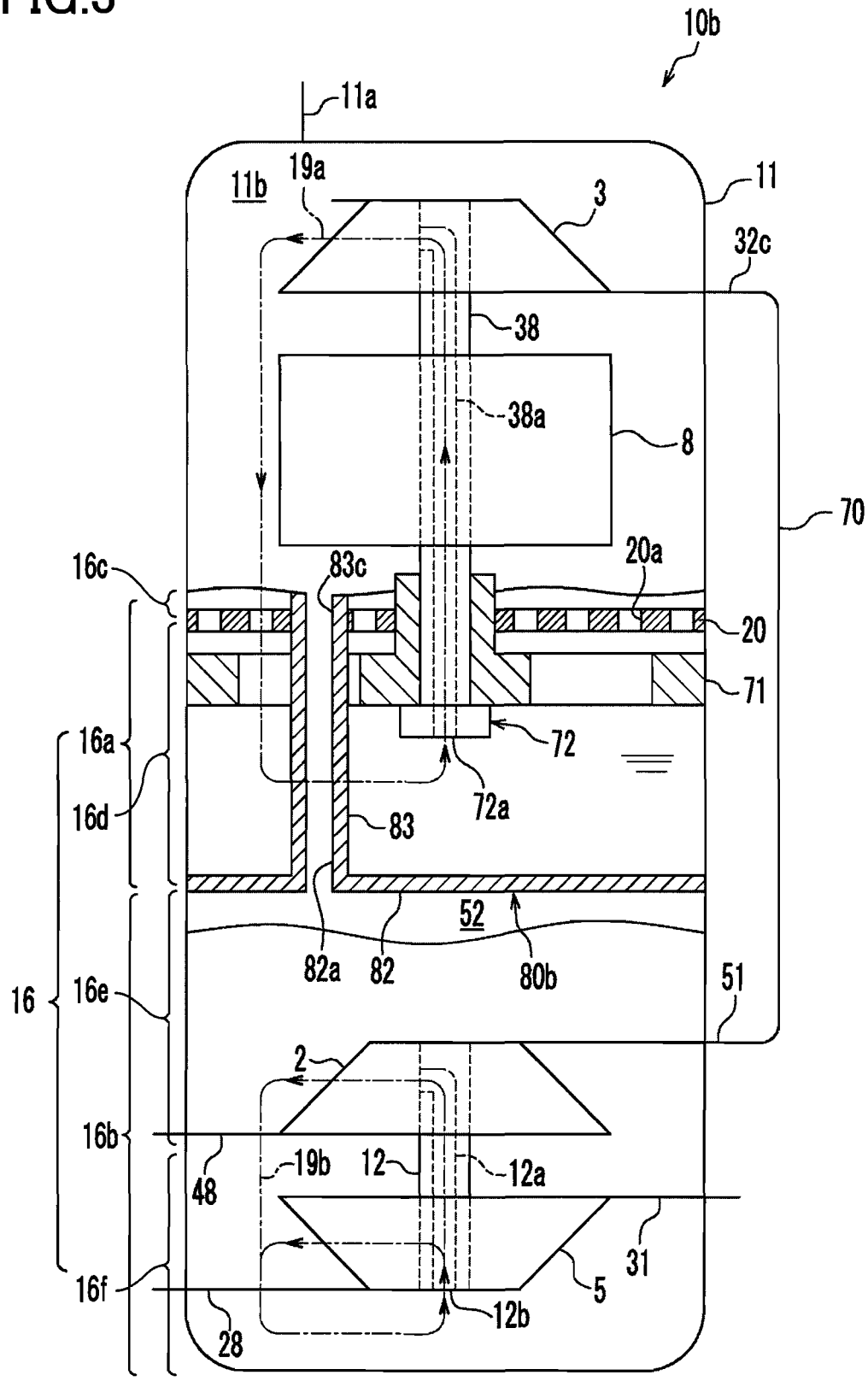
FIG. 3 is a schematic configuration diagram of a fluid machine in a second embodiment.

FIG. 3 is a schematic configuration diagram of a fluid machine 10*b* according to a second embodiment. Hereinafter, the configuration of the fluid machine 10*b* according to the second embodiment will be described with reference to FIG. 3. The second embodiment will be described also with reference to FIG. 1, as in the first embodiment. Hereinbelow, components having substantially the same functions as those of the first embodiment are denoted by the same reference numerals, and a description thereof will be omitted.

As shown in FIG. 3, in the second embodiment, a heat-insulating structure 80*b* is provided in place of the heat-insulating structure 80*a* of the first embodiment. The heat-insulating structure 80*b* has a plate portion 82 and a tube portion 83. The plate portion 82 and the tube portion 83 may be integrated into one body. The plate portion 82 and the tube portion 83 may be separate bodies.

The plate portion 82 is disposed between the upper portion 16*a* and the lower portion 16*b* to divide the oil reservoir into the upper portion 16*a* and the lower portion 16*b* (separate the upper portion 16*a* and the lower portion 16*b*). The plate portion 82 has an opening 82*a* for communicating the upper portion 16*a* and the lower portion 16*b*. The tube portion 83 extends upwardly from the plate portion 82 slightly above the oil agitation suppressing plate 20 through the upper portion 16*a*. A through-hole 83*c* of the tube member 83 communicates with the opening 82*a*. Therefore, also in the second embodiment, refrigerating machine oil can flow between the upper portion 16*a* and the lower portion 16*b* through the through-hole 83*c* and the opening 82*a*, as in the first embodiment.

In the second embodiment, the oil reservoir 16 is divided into two by the heat-insulating structure 80*b* having the above-mentioned structure. Specifically, the oil reservoir 16 is divided into the upper portion 16*a* located above the heat-insulating structure 80*b* and the lower portion 16*b* located below the heat-insulating structure 80*b*. Thereby, a gas refrigerant layer 52 is formed between the plate portion 82 and the lower portion 16*b*. The gas refrigerant layer 52 may disappear when a large amount of refrigerating machine oil is contained in the closed casing 11.

<Functions and Effects>

As described above, the main compression mechanism 3 first discharges the compressed refrigerant into the closed casing 11, while the mechanical power recovery mechanism 5 discharges the refrigerant directly to the refrigerant circuit 9. Therefore, the amount of refrigerating machine oil flowing into the refrigerant circuit 9 together with the refrigerant discharged from the mechanical power recovery mechanism 5 normally is larger than the amount of refrigerating machine oil flowing into the refrigerant circuit 9 together with the refrigerant discharged from the main compression mechanism 3. Accordingly, in general, the amount of refrigerating machine oil contained in the lower portion 16*b* tends to decrease, while the amount of refrigerating machine oil contained in the upper portion 16*a* tends to increase.

Here, in the second embodiment, when an excess amount of refrigerating machine oil is contained in the upper portion 16*a*, the refrigerating machine oil drops into the lower portion 16*b* through the through-hole 83*c* and the opening 82*a*. Thereby, an excessive decrease in the amount of refrigerating machine oil in the upper portion 16*a* and the lower portion 16*b* is suppressed. As a result, the high reliability of the refrigeration cycle apparatus 1 is achieved.

In the second embodiment, the upper portion 16*a* and the lower portion 16*b* are separated from each other by the heat-insulating structure 80*b*. Therefore, the refrigerating machine oil in the upper portion 16*a* never flows into the lower portion 16*b* and the refrigerating machine oil in the lower portion 16*b* never flows into the upper portion 16*a* unless the refrigerating machine oil in the upper portion 16*a* overflows. Accordingly, heat transfer between the main compression mechanism 3 and the mechanical power recovery mechanism 5 is suppressed particularly effectively.

In the second embodiment, the gas refrigerant layer 52 having a relatively low thermal conductivity is formed between the heat-insulating structure 80*b* and the lower portion 16*b*. Thereby, heat transfer between the upper layer 16*a* and the lower layer 16*b* is suppressed more effectively. As a result, the COP of the refrigeration cycle apparatus 1 is improved further.

Third Embodiment

Figure 4:
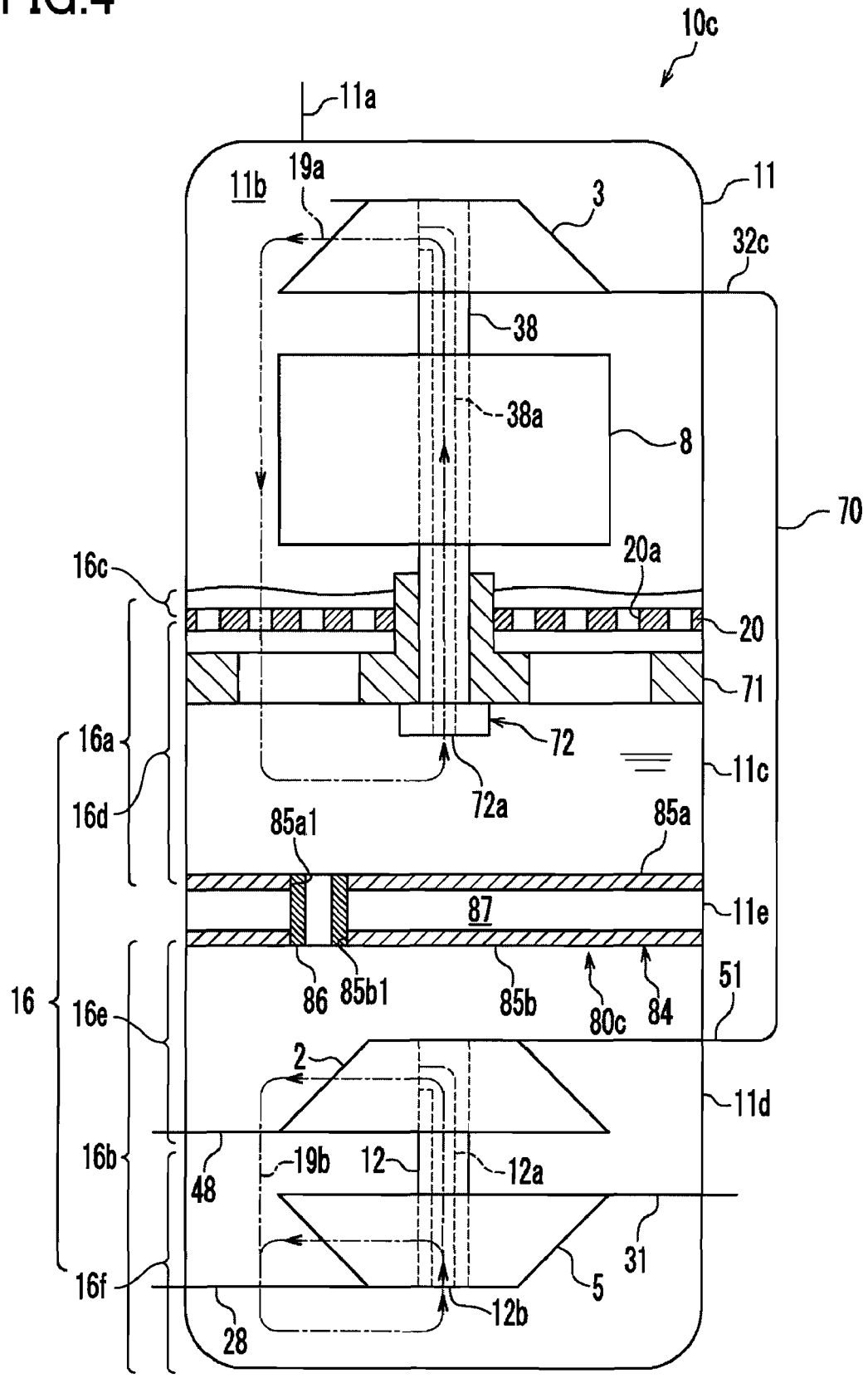
FIG. 4 is a schematic configuration diagram of a fluid machine in a third embodiment.

FIG. 4 is a schematic configuration diagram of a fluid machine 10*c* according to a third embodiment. Hereinafter, the configuration of the fluid machine 10*c* according to the third embodiment will be described with reference to FIG. 4. The third embodiment will be described also with reference to FIG. 1, as in the first embodiment. Hereinbelow, components having substantially the same functions as those of the first embodiment are denoted by the same reference numerals, and a description thereof will be omitted.

As shown in FIG. 4, in the third embodiment, a heat-insulating structure 80*c* is provided in place of the heat-insulating structure 80*a* of the first embodiment. The heat-insulating structure 80*c* has a plate member 84 and a tube member 86. The plate member 84 is disposed between the upper portion 16*a* and the lower portion 16*b* to partition the oil reservoir into the upper portion 16*a* and the lower portion 16*b* (separate the upper portion 16*a* and the lower portion 16*b*). The plate member 84 is constituted by two plate members 85*a* and 85*b* disposed parallel to each other. An interior space 87 is formed between the plate member 85*a* and the plate member 85*b*. That is, the plate member 84 has the interior space 87 for spacing the plate member 85*a* as a surface portion located on the side of the upper portion 16*a* apart from the plate member 85*b* as a surface portion located on the side of the lower portion 16*b*. The interior space 87 is formed throughout the region between the plate member 85*a* and the plate member 85*b* except a region where the tube portion 86 is disposed. The interior space 87 is formed to face the inner wall of the closed casing 11. That is, the interior space 87 is surrounded by the inner wall of the closed casing 11, the plate member 85*a*, the plate member 85*b* and the outer peripheral surface of the tube member 86.

The plate member 85*a* has an opening 85*a*1 opening to the upper portion 16*a*. On the other hand, the plate member 85*b* has an opening 85*b*1 opening to the lower portion 16*b* at a position corresponding to the opening 85*a*1 with respect to the axial direction of the main compression mechanism side shaft 38. The tube member 86 is disposed to communicate the opening 85*a*1 and the opening 85*b*1. Refrigerating machine oil can flow between the upper portion 16*a* and the lower portion 16*b* through this tube member 86.

In the third embodiment, the interior space 87 is a space isolated from other parts of the interior space 11*b* in the closed casing 11. The interior space 87 may be filled with a refrigerant as a working fluid, oil such as refrigerating machine oil, or the like. Preferably, the interior space 87 is filled with a material having a low thermal conductivity. Particularly preferably, the interior space 87 is filled with a material having a lower thermal conductivity than that of refrigerating machine oil.

For example, the pressure in the interior space 87 may be reduced. Specifically, the pressure in the interior space 87 may be lower than that in other parts of the interior space 11*b*. Furthermore, the pressure in the interior space 87 may be lower than that in the low pressure side of the refrigerant circuit 9. The interior space 87 may be substantially vacuum.

<Functions and Effects>

Normally, the closed casing 11 is made of a material having a relatively high thermal conductivity, such as a metal. Therefore, even if the flow of refrigerating machine oil between the upper portion 16*a* and the lower portion 16*b* is inhibited, heat transfer may occur between the upper portion 16*a* and the lower portion 16*b* via the heat-insulating structure 80*c* and the closed casing 11. As a result, heat transfer occurs between the main compression mechanism 3 and the mechanical power recovery mechanism 5, and thereby the COP of the refrigeration cycle apparatus 1 may decrease.

In contrast, in the third embodiment, the heat-insulating structure 80*c* corresponds to the heat-insulating structure 80*a* constituted by the plate member 81 of the above first embodiment, in which the interior space 87 for spacing the upper part of the plate member 81 apart from the lower part thereof is formed. Therefore, the thermal conductivity of the heat-insulating structure 80*c* is lower than that of the heat-insulating structure 80*a* of the above first embodiment. A distance between the upper portion 16*a* and the lower portion 16*b* can be increased further. As a result, the heat-insulating structure 80*c* serves as a thermal barrier between the upper portion 16*a* and the lower portion 16*b*, and thereby suppresses more effectively the heat transfer between the upper portion 16*a* and the lower portion 16*b*.

Preferably, the thermal conductivity of the interior space 87 is lower than that of refrigerating machine oil. Thereby, heat transfer between the upper portion 16*a* and the lower portion 16*b* can be suppressed particularly effectively.

Specifically, it is preferable that the interior space 87 is filled with a material having a lower thermal conductivity than that of refrigerating machine oil. Examples of the material having a lower thermal conductivity than that of refrigerating machine oil include a gas such as air and a refrigerant as a working fluid, a liquid such as another oil having a lower thermal conductivity than that of the refrigerating machine oil contained in the oil reservoir 16, and a solid heat-insulating material.

In the case where the interior space 87 is filled with a gas, it is preferable that the pressure of the interior space 87 is reduced. In the case where the interior space 87 is filled with a gas, it is particularly preferable that the interior space 87 is evacuated substantially.

In the third embodiment, the interior space 87 faces the inner wall of the closed casing 11. Therefore, as shown in FIG. 4, it is possible to separate a high temperature part 11*c* of the closed casing 11 adjacent to the upper portion 16*a* in which relatively high temperature refrigerating machine oil is contained from a low temperature part 11*d* of the closed casing 11 adjacent to the lower portion 16*b* in which relatively low temperature refrigerating machine oil is contained. In other words, a medium temperature part 11*e* facing the interior space 87 can be provided between the high temperature part 11*c* and the low temperature part 11*d*. Thereby, heat transfer from the high temperature part 11*c* to the low temperature part 11*d* can be suppressed. As a result, heat transfer between the upper portion 16*a* and the lower portion 16*b*, which occurs via the closed casing 11, can be suppressed. Accordingly, by forming the interior space 87 facing the inner wall of the closed casing 11, heat transfer between the main compression mechanism 3 and the mechanical power recovery mechanism 5 can be suppressed more effectively. As a result, the COP of the refrigeration cycle apparatus 1 can be improved further.

<<First Modification>>

Figure 5:
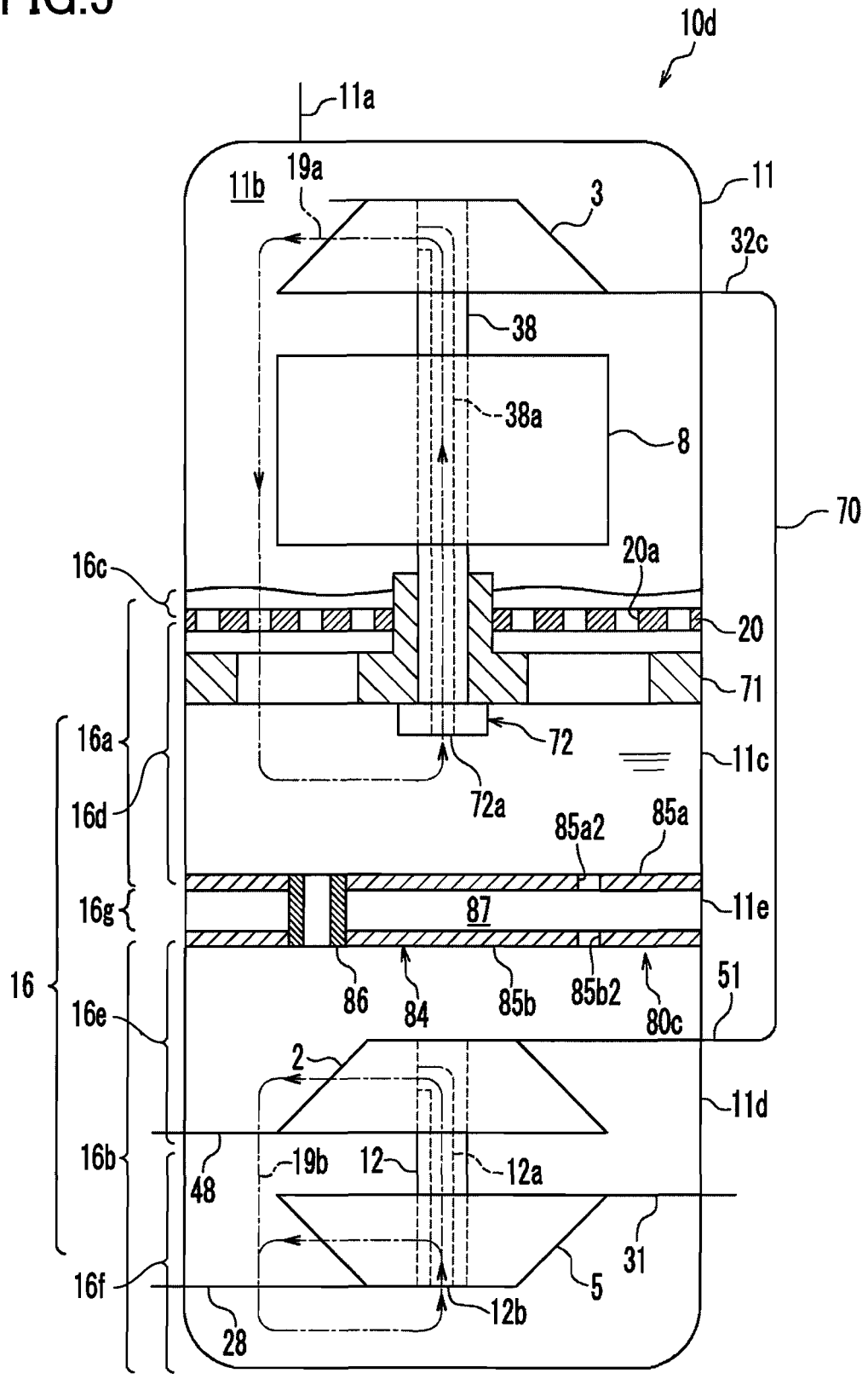
FIG. 5 is a schematic configuration diagram of a fluid machine in a first modification.

In the third embodiment, the example where the interior space 87 is isolated from other parts of the interior space 11*b* in the closed casing 11 has been described. However, the present invention is not limited to this example. For example, as shown in FIG. 5, the interior space 87 may communicate with other parts of the interior space 11*b* of the closed casing 11. Specifically, the plate member 85*a* and the plate member 85*b* may have one or more openings 85*a*2 and openings 85*b*2 respectively. In doing so, the interior space 87 can be filled with the refrigerating machine oil. As a result, an additional refrigerating machine oil layer 16*g* can be formed between the upper portion 16*a* and the lower portion 16*b*.

For example, in the first embodiment, a certain amount of heat transfer occurs between the upper portion 16*a* and the lower portion 16*b* via the plate member 81. Thereby, the temperature of the refrigerating machine oil located closer to the upper portion 16*a* in the lower portion 16*b* increases. In the above first embodiment, the heated refrigerating machine oil is not separated from other relatively low temperature refrigerating machine oil in the lower portion 16*b*. Therefore, the heated refrigerating machine oil is mixed with other refrigerating machine oil in the lower portion 16*b* by the convection of the refrigerating machine oil in the lower portion 16*b*. As a result, the temperature of the refrigerating machine oil in the lower portion 16*b* increases to a certain extent. Simultaneously, the temperature of the refrigerating machine oil located close to the lower portion 16*b* in the upper portion 16*a* decreases. In the above first embodiment, the cooled refrigerating machine oil also is not separated from other refrigerating machine oil located in the upper portion 16*a*. Therefore, the cooled refrigerating machine oil is mixed with other relatively high temperature refrigerating machine oil in the upper portion 16*a* by the convection of the refrigerating machine oil in the upper portion 16*a*. As a result, the temperature of the refrigerating machine oil in the upper portion 16*a* decreases to a certain extent. As described above, in the above first embodiment, the temperature of the refrigerating machine oil located close to the heat-insulating structure 80*a* changes, and the refrigerating machine oil whose temperature has thus changed is mixed by convection. Therefore, a certain amount of heat transfer occurs between the main compression mechanism 3 and the mechanical power recovery mechanism 5.

In contrast, in the first modification, an additional refrigerating machine oil layer 16*g* is formed between the upper portion 16*a* and the lower portion 16*b*. In the case of the first modification, heat transfer occurs between the refrigerating machine oil in the additional refrigerating machine oil layer 16*g*, and the refrigerating machine oil in the upper layer 16*a* and the refrigerating machine oil in the lower layer 16*b* respectively. The additional refrigerating machine oil layer 16*g* is separated from both the upper portion 16*a* and the lower portion 16*b*. Therefore, the refrigerating machine oil located in the additional refrigerating machine oil layer 16*g* and heated by the upper portion 16*a* is not mixed substantially with the refrigerating machine oil in the lower portion 16*b*. Likewise, the refrigerating machine oil located in the additional refrigerating machine oil layer 16*d* and cooled by the lower portion 16*b* is not mixed substantially with the refrigerating machine oil in the upper portion 16*a*. That is, heat is exchanged between the upper portion 16*a* and the lower portion 16*b* substantially only by heat transfer through the additional refrigerating machine oil layer 16*g*. Accordingly, in the case where the interior space 87 is filled with refrigerating machine oil so as to form the additional refrigerating machine oil layer 16*g*, as in the first modification, heat transfer between the upper portion 16*a* and the lower portion 16*b* can be suppressed more effectively.

This effect can be obtained even if only one of the openings 85*a*2 and 85*b*2 is formed. However, in view of the difficulty in charging the interior space 87 with refrigerating machine oil, it is more preferable to provide both the openings 85*a*2 and 85*b*2.

Fourth Embodiment

Figure 6:
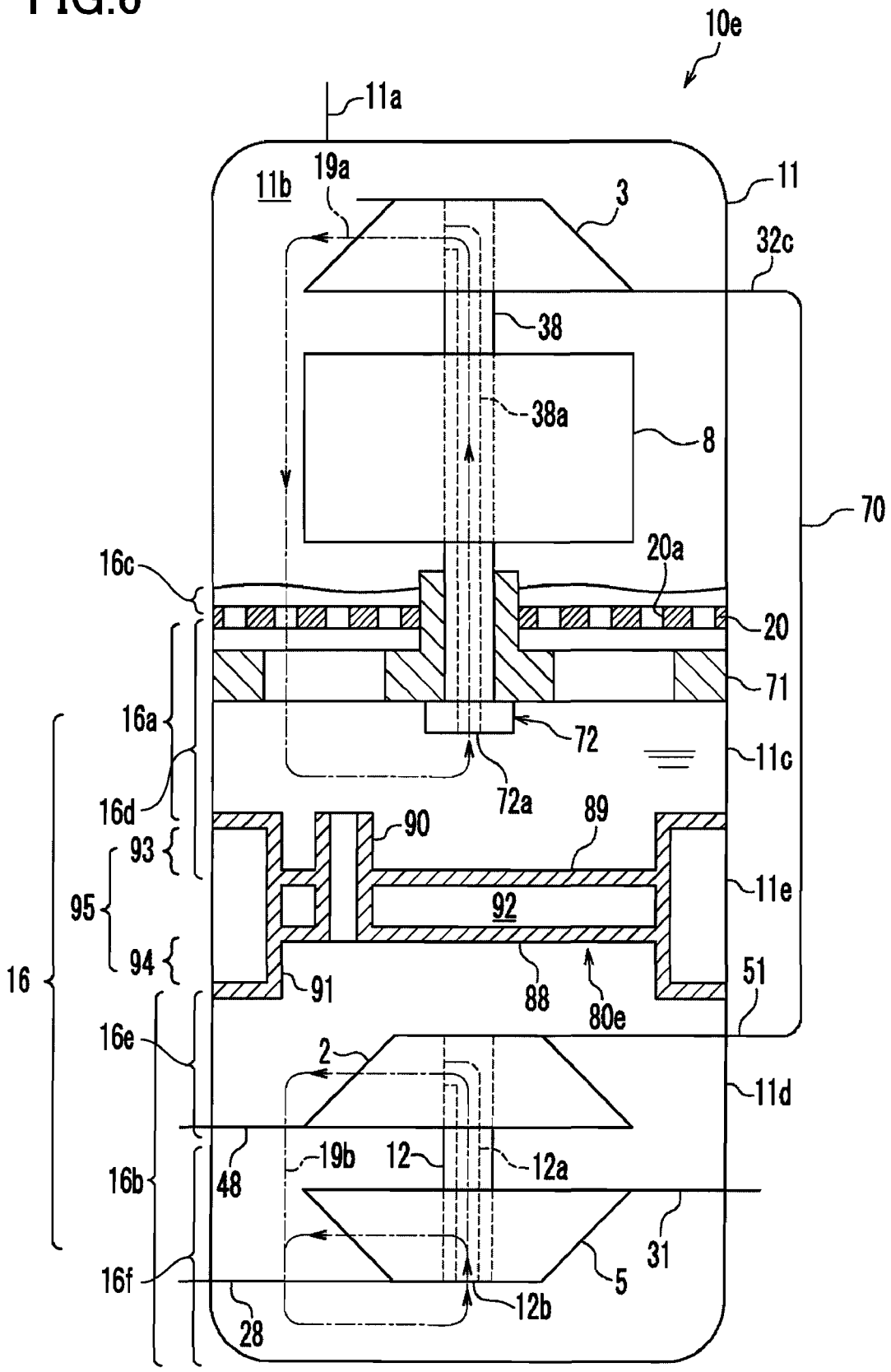
FIG. 6 is a schematic configuration diagram of a fluid machine in a fourth embodiment.
Figure 7:
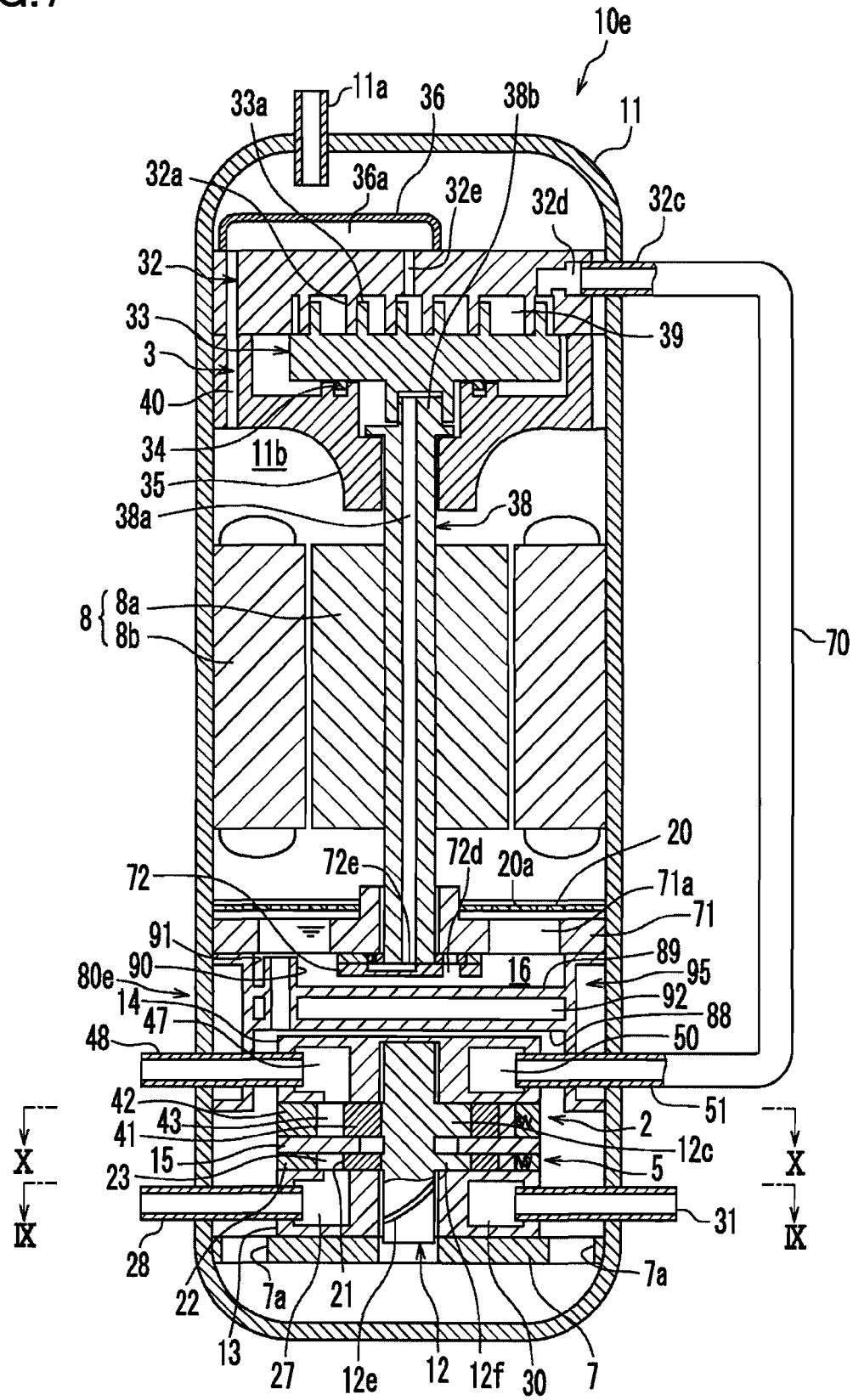
FIG. 7 is a cross-sectional view of the fluid machine in the fourth embodiment.

FIG. 6 is a schematic configuration diagram of a fluid machine 10*e* according to a fourth embodiment. FIG. 7 is a cross-sectional view of the fluid machine 10*e* according to the fourth embodiment. Hereinafter, the configuration of the fluid machine 10*e* according to the fourth embodiment will be described with reference to FIG. 6, FIG. 7, etc. The fourth embodiment will be described also with reference to FIG. 1, as in the first embodiment. Hereinbelow, components having substantially the same functions as those of the first embodiment are denoted by the same reference numerals, and a description thereof will be omitted.

First, a schematic configuration of the fluid machine 10*e* according to the fourth embodiment will be described with reference to FIG. 6. In the fourth embodiment, a heat-insulating structure 80*e* is provided in place of the heat-insulating structure 80*a* of the above first embodiment. The heat-insulating structure 80*e* has a pair of plate portions 88 and 89 disposed parallel to each other. These plate portions 88 and 89 restrict the flow of refrigerating machine oil between the upper portion 16*a* and the lower portion 16*b*.

An interior space 92 is formed between the plate portion 88 and the plate portion 89. Like the interior space 87 described in the above third embodiment, this interior space 92 may be filled with a refrigerant, refrigerating machine oil, a solid heat-insulating material, or the like. The pressure in the interior space 92 may be reduced.

The plate portions 88 and 89 are provided with a tube portion 90. Specifically, the tube portion 90 extends upwardly from the plate portion 88 and protrudes above the plate portion 89. This tube portion 90 allows the refrigerating machine oil to flow between the upper portion 16*a* and the lower portion 16*b*.

Each of the plate portions 88 and 89 is disposed in the center of the interior space 11*b* of the closed casing 11 in plan view so that it is located at a position spaced apart from the inner wall of the closed casing 11. A peripheral portion 91 is disposed between the plate members 88 and 89, and the inner wall of the closed casing 11. The peripheral portion 91 is formed in an approximately cylindrical shape (ring shape) and is circular in plan view.

In the fourth embodiment, an example where the peripheral portion 91, the plate portions 88 and 89, and the tube portion 90 are formed as one body will be described. However, this is merely an example, and the present invention is not limited to this structure. The peripheral portion 91, the plate portion 88, the plate portion 89, and the tube portion 90 may be constituted by separate bodies.

The peripheral portion 91 is formed to extend from a position above the plate portion 89 to a position below the plate portion 88 in the vertical direction. That is, the peripheral portion 91 has a part located above the plate portion 89 on the side of the upper portion 16*a* and a part located below the plate portion 88 on the side of the lower portion 16*b*.

At this peripheral portion 91, the heat-insulating structure 80*e* is mounted on the inner wall of the closed casing 11. In the peripheral portion 91, an interior space 95 is formed to face the inner wall of the closed casing 11. The upper end of the interior space 95 extends above the plate portion 89. On the other hand, the lower end of the interior space 95 extends below the plate portion 88. In other words, the interior space 95 is formed extending from a position above the plate portion 89 to a position below the plate portion 88. That is, the interior space 95 has a first interior space 93 located above the plate portion 89 on the side of the upper portion 16*a* and a second interior space 94 located below the plate portion 88 on the side of the lower portion 16*b*. These first interior space 93 and second interior space 94 each face the inner wall of the closed casing 11.

The interior space 95 may include only one of the first interior space 93 located above the plate portion 89 on the side of the upper portion 16*a* and the second interior space 94 located below the plate portion 88 on the side of the lower portion 16*b*.

The specific structures of the rotation motor 8, the main compression mechanism 3, the sub-compression mechanism 2, and the mechanical power recovery mechanism 5 in the fourth embodiment will be described below in detail with reference to FIGS. 7 to 12. The rotation motor 8, the main compression mechanism 3, the sub-compression mechanism 2, and the mechanical power recovery mechanism 5 are the components common to the first to seventh embodiments and the first modification. The following description is referred to in connection with the first to third embodiments, fifth to seventh embodiments and the first modification.

(Rotation Motor 8)

First, the rotation motor 8 and the main compression mechanism 3 will be described with reference to FIG. 7. As shown in FIG. 7, the rotation motor 8 has a cylindrical stator 8*b* and a columnar rotor 8*a*. The stator 8*b* is fixed unrotatably to the closed casing 11 by shrink fitting. The rotor 8*a* is disposed inside the stator 8*b*. The rotor 8*a* is disposed rotatably with respect to the stator 8*b*. A through-hole penetrating the rotor 8*a* in the axial direction is formed in the center thereof in plan view. The main compression mechanism side shaft 38 extending vertically is inserted in the through-hole of the rotor 8*a* and fixed thereto. This main compression mechanism side shaft 38 is rotated when the rotation motor 8 is driven.

The lower end portion of the main compression mechanism side shaft 38 is supported rotatably to an approximately disk-shaped sub-bearing member 71 fixed to the closed casing 11. The sub-bearing member 71 is disposed in the oil reservoir 16. The sub-bearing member 71 is provided with one or more openings 71*a* so that the refrigerating machine oil contained in the oil reservoir 16 flows between above and below relative to the sub-bearing member 71.

(Oil Pump 72)

At the lower end portion of the main compression mechanism side shaft 38, the oil pump 72 serving as an oil supply portion is mounted. The type of the oil pump 72 is not particularly limited. An example where the oil pump 72 is a trochoid pump will be described below with reference to FIG. 8.

Figure 8:
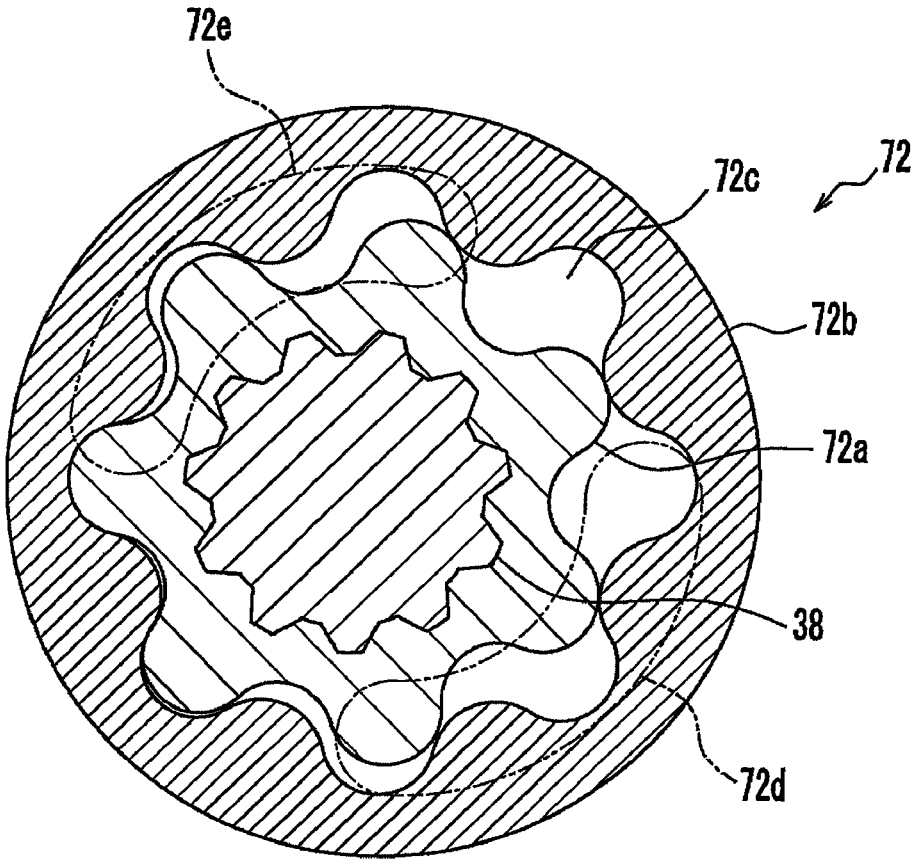
FIG. 8 is a cross-sectional view of an oil pump.

As shown in FIG. 8, the oil pump 72 has gear-shaped inner rotor 72*a* and outer rotor 72*b*. The inner rotor 72*a* is attached to the main compression mechanism side shaft 38. Thereby, the inner rotor 72*a* rotates with the rotation of the main compression mechanism side shaft 38. The outer rotor 72*b* is formed in a cylindrical shape having a gear-shaped interior space. Specifically, the interior space of the outer rotor 72*b* is formed in a gear shape having a smaller number of teeth than that of the inner rotor 72*a*. The inner rotor 72*a* is disposed inside the outer rotor 72*b*. The outer rotor 72*b* is disposed rotatably. The outer rotor 72*b* is disposed in an eccentric manner with respect to the inner rotor 72*a*. Thereby, when the inner rotor 72*a* rotates together with the main compression mechanism side shaft 38, the volumetric capacity of a working chamber 72*c* formed by the inner rotor 72*a* and the outer rotor 72*b* changes. As the volumetric capacity of the working chamber 72*c* changes, the refrigerating machine oil drawn from the suction port 72*d* is discharged from the discharge port 72*e*. The refrigerating machine oil discharged from the discharge port 72*e* is supplied to the main compression mechanism 3 through the oil supply passage 38*a* formed inside the main compression mechanism side shaft 38. Thereby, the sliding parts of the main compression mechanism 3 are lubricated and sealed. The refrigerating machine oil supplied to the main compression mechanism 3 is returned again to the oil reservoir 16 through the gap between the rotor 8*a* and the stator 8*b*, and the like.

(Main Compression Mechanism 3)

As shown in FIG. 7, the main compression mechanism 3 is a scroll-type compression mechanism. The main compression mechanism 3 is fixed to the closed casing 11. The main compression mechanism 3 includes a stationary scroll 32, an orbiting scroll 33, an Oldham ring 34, a bearing member 35, and a muffler 36.

The stationary scroll 32 is mounted on the closed casing 11 such that the stationary scroll 32 cannot move. A lap 32*a* of a spiral shape (for example, an involute shape) in plan view is formed on the lower surface of the stationary scroll 32. The orbiting scroll 33 is disposed to face the stationary scroll 32. At the center on the surface of the orbiting scroll 33 facing the stationary scroll 32, a lap 33*a* of a spiral shape (for example, an involute shape) in plan view that meshes with the lap 32*a* is formed. A crescent-shaped working chamber (compression chamber) 39 is formed between the lap 32*a* and the lap 33*a*.

The suction passage 32*d* opening to the working chamber 39 is formed in the stationary scroll 32. This suction passage 32*d* is joined with a suction pipe 32*c*. The suction pipe 32*c* is connected to the discharge pipe 51 of the sub-compression mechanism 2 via the connecting pipe 70. A refrigerant is supplied to the working chamber 39 through the connecting pipe 70 and the suction pipe 32*c*.

An eccentric portion 38*b* is engaged to the center of the lower surface of the orbiting scroll 33 by being fitted thereinto. The eccentric portion 38*b* is formed on the upper end portion of the main compression mechanism side shaft 38 extending from the rotor 8*a*. The eccentric portion 38*b* has a central axis displaced from that of the main compression mechanism side shaft 38. The Oldham ring 34 is disposed below the orbiting scroll 33. The Oldham ring 34 restrains the rotation of the orbiting scroll 33. Under the restraint of this Oldham ring 34, with the rotation of the main compression mechanism side shaft 38, the orbiting scroll 33 performs an orbiting motion in an eccentric manner with respect to the central axis of the main compression mechanism side shaft 38.

With the orbiting motion of the orbiting scroll 33, the working chamber 39 formed between the lap 32*a* and the lap 33*a* moves from outside to inside. With this movement, the volumetric capacity of the working chamber 39 is reduced. Thereby, the refrigerant drawn into the working chamber 39 through the suction pipe 32*c* and the suction passage 32*d* is compressed. The compressed refrigerant passes through the discharge port 32*e* formed in the center of the stationary scroll 32 and the interior space 36*a* of the muffler 36, and then is discharged into the interior space 11*b* in the closed casing 11 through the discharge passage 40 formed penetrating the stationary scroll 32 and the bearing member 35. The discharged refrigerant is retained temporarily in the interior space 11*b*. During a period of time in which the refrigerant is retained, the refrigerating machine oil and the like mixed into the refrigerant are separated by gravitational force and centrifugal force. Then, the refrigerant from which the refrigerating machine oil and the like have been separated is discharged into the refrigerant circuit 9 through the discharge pipe 11*a* provided in the closed casing 11.

(Mechanical Power Recovery Mechanism 5)

The mechanical power recovery mechanism 5 is disposed below the sub-compression mechanism 2 in the oil reservoir 16. In other words, the mechanical power recovery mechanism 5 is disposed at a position farther from the main compression mechanism 3 than the sub-compression mechanism 2. The mechanical power recovery mechanism 5 and the sub-compression mechanism 2 are disposed in an integrated manner via the mechanical power recovery shaft 12 and the first closing member 15.

In the fourth embodiment, an example where the mechanical power recovery mechanism 5 is constituted by a rotary-type fluid pressure motor will be described. Specifically, the mechanical power recovery mechanism 5 carries out, in a substantially continuous manner, a process in which a refrigerant is drawn from the high pressure side of the refrigerant circuit 9 and a process in which the drawn refrigerant is discharged. That is, the mechanical power recovery mechanism 5 draws the refrigerant from the high pressure side of the refrigerant circuit 9 and discharges it to the low pressure side of the refrigerant circuit 9 without changing substantially the volumetric capacity of the refrigerant. In the discharge process, the pressure of the refrigerant to be discharged is reduced to the pressure on the low pressure side of the refrigerant circuit 9.

In the present invention, the mechanical power recovery mechanism 5 is not limited to a rotary-type fluid pressure motor. The mechanical power recovery mechanism 5 may be a fluid pressure motor other than the rotary type. The mechanical power recovery mechanism 5 may be, for example, an expansion mechanism.

—Structure of Mechanical Power Recovery Mechanism 5—

As shown in FIG. 7, the mechanical power recovery mechanism 5 includes the first closing member 15 and the second closing member 13. The first closing member 15 and the second closing member 13 face each other. A first cylinder 22 is disposed between the first closing member 15 and the second closing member 13. The first cylinder 22 has an approximately cylindrical interior space. The interior space of the first cylinder 22 is closed by the first closing member 15 and the second closing member 13.

The mechanical power recovery mechanism 5 is fixed to the closed casing 11 by an approximately disk-shaped mounting member 7 located below the second closing member 13. One or more through-holes 7*a* penetrating the mounting member 7 vertically are formed in the mounting member 7. Thereby, the refrigerating machine oil can flow between above and below relative to the mounting member 7.

The mechanical power recovery shaft 12 penetrates the first cylinder 22 in the axial direction thereof. The mechanical power recovery shaft 12 is disposed on the central axis of the first cylinder 22. The mechanical power recovery shaft 12 is supported by the above-mentioned second closing member 13 and a third closing member 14 to be described later. An oil supply groove 12*e* is formed in a spiral shape in the mechanical power recovery shaft 12. The refrigerating machine oil in the closed casing 11 is supplied to the sliding parts of the sub-compression mechanism 2 and the mechanical power recovery mechanism 5 respectively through the oil supply groove 12*e*.

The first piston 21 is disposed in an approximately cylindrical interior space formed by the inner peripheral surface of the first cylinder 22, the first closing member 15 and the second closing member 13. The first piston 21 is fitted to the mechanical power recovery shaft 12 in an eccentric manner with respect to the central axis of the mechanical power recovery shaft 12. Specifically, the mechanical power recovery shaft 12 includes an eccentric portion 12*f* having a central axis displaced from that of the mechanical power recovery shaft 12. The cylindrical first piston 21 is fitted to the eccentric portion 12*f*. Therefore, the first piston 21 is eccentric with respect to the central axis of the first cylinder 22. Accordingly, the first piston 21 performs an eccentric rotational motion with the rotation of the mechanical power recovery shaft 12.

Figure 9:
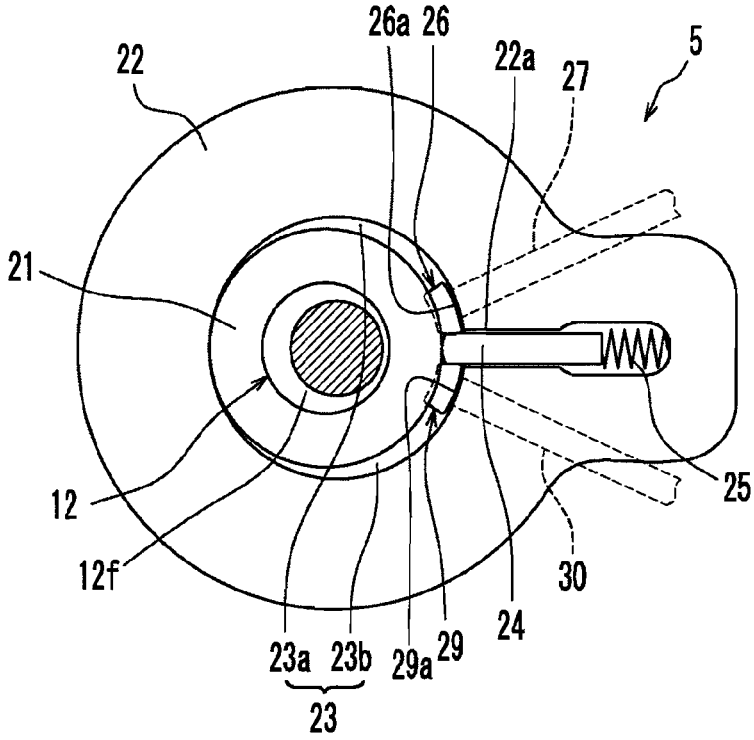
FIG. 9 is a view taken along arrows IX-IX in FIG. 7.

In the first cylinder 22, a first working chamber 23 is formed by the first piston 21, the inner peripheral surface of the first cylinder 22, the first closing member 15, and the second closing member 13 (see also FIG. 9).

As shown in FIG. 9, a linear groove 22*a* opening to the first working chamber 23 is formed in the first cylinder 22. A plate-like first partition member 24 is inserted slidably into the linear groove 22*a*. A biasing means 25 is disposed between the first partition member 24 and the bottom portion of the linear groove 22*a*. The first partition member 24 is pressed against the outer peripheral surface of the first piston 21 by the biasing means 25. Thereby, the first working chamber 23 is partitioned into two spaces. Specifically, the first working chamber 23 is partitioned into a high pressure side suction chamber 23*a* and a low pressure side discharge chamber 23*b*.

The biasing means 25 can be constituted by, for example, a spring. Specifically, the biasing means 25 may be a compression coil spring. The biasing means 25 may be a so-called gas spring.

As shown in FIG. 9, the suction passage 27 opens to a portion in the suction chamber 23*a* adjacent to the first partition member 24. As shown in FIG. 7, the suction passage 27 is formed in the second closing member 13 located below the first cylinder 22. The suction passage 27 communicates with the suction pipe 28.

The opening (suction port) 26 of the suction passage 27 opening to the suction chamber 23*a* is formed in an approximately fan shape extending in an arc shape from the portion adjacent to the first partition member 24 in the suction chamber 23*a* toward the direction in which the suction chamber 23*a* spreads out. The suction port 26 is completely closed by the first piston 21 only when the first piston 21 is located at a top dead center. At least a part of the suction port 26 is exposed to the suction chamber 23*a* at all times except for a moment when the first piston 21 is located at the top dead center. Specifically, in plan view, the outer edge 26*a* of the suction port 26 is formed in an arc shape along the outer peripheral surface of the first piston 21 located at the top dead center. In other words, the outer edge 26*a* is formed in the shape of an arc having almost the same radius as that of the outer peripheral surface of the first piston 21.

On the other hand, the discharge passage 30 opens to a portion in the discharge chamber 23*b* adjacent to the first partition member 24. As shown in FIG. 7, this discharge passage 30 also is formed in the second closing member 13, as in the case of the suction passage 27. The discharge passage 30 communicates with the discharge pipe 31.

As shown in FIG. 9, the opening (discharge port) 29 of the discharge passage 30 opening to the discharge chamber 23*b* is formed in an approximately fan shape extending in an arc shape from the portion adjacent to the first partition member 24 in the discharge chamber 23*b* toward the direction in which the discharge chamber 23*b* spreads out. The discharge port 29 is completely closed by the first piston 21 only when the first piston 21 is located at a top dead center. At least a part of the discharge port 29 is exposed to the discharge chamber 23*b* at all times except for a moment when the first piston 21 is located at the top dead center. Specifically, in plan view, the outer edge 29*a* of the discharge port 29 located outside in the radial direction of the first cylinder 22 is formed in an arc shape along the outer peripheral surface of the first piston 21 located at the top dead center. In other words, the outer edge 29*a* is formed in a shape of an arc having almost the same radius as that of the outer peripheral surface of the first piston 21.

Figure 11:
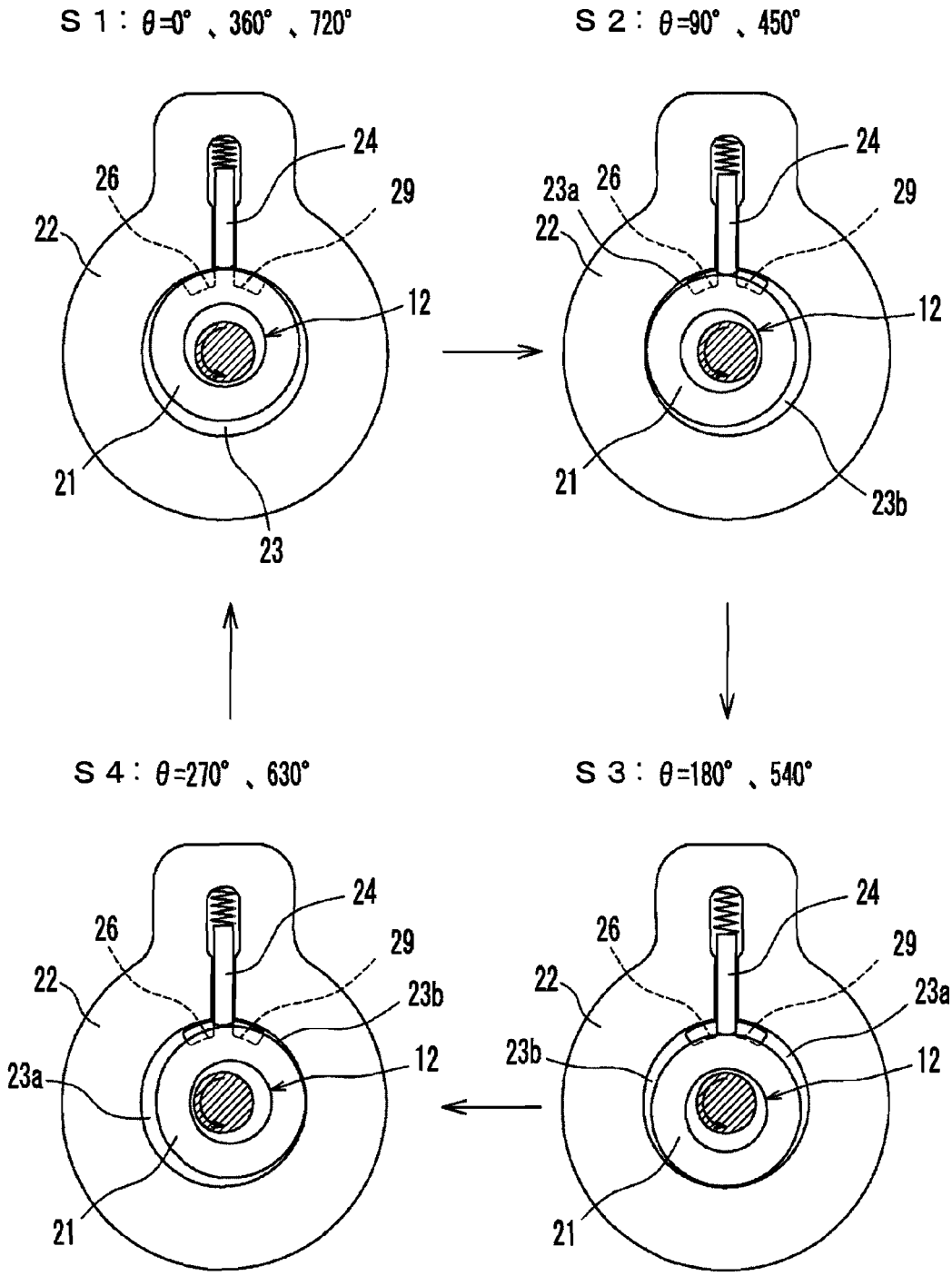
FIG. 11 is an operating principle diagram of an expansion mechanism.

As shown in the upper left of FIG. 11, the moment when the first piston 21 is located at the top dead center is a moment when the central axis (eccentric axis) of the first piston 21 is located closest to the first partition member 24. The "moment when the first piston 21 is located at the top dead center" is not limited strictly to a moment when the first piston 21 is located at the top dead center, and it may be a certain period of time including the moment when the first piston 21 is located at the top dead center. It is assumed here that the rotational angle (θ) of the first piston 21 is 0 degree when the first piston 21 is located at the top dead center. Under this assumption, for example, a structure in which both the suction port 26 and the discharge port 29 are closed throughout a period of time during which the rotational angle (θ) of the first piston 21 is within a range of 0±5 degrees also is included in a structure in which leakage from the suction passage 27 to the discharge passage 30 does not occur.

In the case where the suction passage 27 and the discharge passage 30 are formed as described above, both the suction port 26 and the discharge port 29 are closed completely only at a moment when the first piston 21 is located at the top dead center, as shown in the upper left of FIG. 11. That is, at a moment when the first working chamber 23 is present alone, both the suction port 26 and the discharge port 29 are closed completely. More specifically, the suction chamber 23*a* is in communication with the suction passage 27 up to the moment when the suction chamber 23*a* communicates with the discharge passage 30. Then, after the moment when the suction chamber 23*a* communicates with the discharge passage 30 and thereby the suction chamber 23*a* shifts to the discharge chamber 23*b*, the suction port 26 is closed by the first piston 21. Therefore, leakage of the refrigerant from the suction passage 27 to the discharge passage 30 is suppressed. Accordingly, mechanical power can be recovered at a high efficiency.

From the viewpoint of preventing completely the leakage of the refrigerant from the suction passage 27 to the discharge passage 30, it is preferable that both the suction port 26 and the discharge port 29 are closed at the moment when the first piston 21 is located at the top dead center. Even in the case where only one of the suction port 26 and the discharge port 29 is closed at the moment when the first piston 21 is located at the top dead center, if a difference between the timing at which the suction port 26 is closed and the timing at which the discharge port 29 is closed is smaller than about 10 degrees in terms of the rotational angle of the mechanical power recovery shaft 12, leakage substantially does not occur between the suction passage 27 and the discharge passage 30. That is, by setting the difference between the timing at which the suction port 26 is closed and the timing at which the discharge port 29 is closed to be smaller than about 10 degrees in terms of the rotational angle of the mechanical power recovery shaft 12, leakage of the refrigerant from the suction passage 27 to the discharge passage 30 can be suppressed.

As described above, the suction chamber 23*a* is always in communication with the suction passage 27. The discharge chamber 23*b* is always in communication with the discharge passage 30. In other words, in the mechanical power recovery mechanism 5, a process in which a refrigerant is drawn and a process in which the drawn refrigerant is discharged are carried out in a substantially continuous manner. Therefore, the drawn refrigerant passes through the mechanical power recovery mechanism 5 without changing its volumetric capacity substantially.

—Operation of Mechanical Power Recovery Mechanism 5—

Next, the operating principle of the mechanical power recovery mechanism 5 will be described in detail with reference to FIG. 11. S1 of FIG. 11 shows a state in which the rotational angle (θ) of the first piston 21 is 0, 360 and 720 degrees. S2 of FIG. 11 shows a state in which the rotational angle (θ) of the first piston 21 is 90 and 450 degrees. S3 of FIG. 11 shows a state in which the rotational angle (θ) of the first piston 21 is 180 and 540 degrees. S4 of FIG. 11 shows a state in which the rotational angle (θ) of the first piston 21 is 270 and 630 degrees. In FIG. 11, a counterclockwise direction is indicated as a positive direction of the rotational angle (θ).

As shown in S1 of FIG. 11, when the first piston 21 is located at the top dead center (θ=0°), both the suction port 26 and the discharge port 29 are closed by the first piston 21. Therefore, the first working chamber 23 is not in communication with either the suction passage 27 or the discharge passage 30 and is in an isolated state.

As the first piston 21 rotates from this state, the suction chamber 23*a* communicating with the suction passage 27 is formed. Here, the suction chamber 23*a* is connected to the high pressure side of the refrigerant circuit 9. Therefore, when the suction port 26 opens, the volumetric capacity of the suction chamber 23*a* is increased by the high-pressure refrigerant flowing thereinto from the suction port 26, as shown in S2 to S4 of FIG. 11. The rotational torque applied to the first piston 21 with the increase in the volumetric capacity of the suction chamber 23*a* serves as a part of the rotational driving force of the mechanical power recovery shaft 12. The refrigerant suction process is carried out until the rotational angle (θ) reaches 360 degrees, that is, until the first piston 21 is located again at the top dead center. In other words, the refrigerant suction process is carried out until immediately before the suction chamber 23*a* communicates with the discharge passage 30.

As shown in S1 of FIG. 11, in the fourth embodiment, the first piston 21 closes both the suction port 26 and the discharge port 29 at a moment when the first piston 21 is located again at the top dead center. Thereby, the first working chamber 23 is isolated again.

As the first piston 21 rotates from this state, the isolated first working chamber 23 communicates with the discharge passage 30 and shifts to the discharge working chamber 23*b*. At a moment when the isolated first working chamber 23 communicates with the discharge passage 30 and shifts to the discharge working chamber 23*b*, the low temperature and high pressure refrigerant in the discharge working chamber 23*b* is drawn to the low pressure side. Thereby, the refrigerant in the first working chamber 23 is expanded. Then, the pressure in the discharge working chamber 23*b* becomes equal to the pressure on the low pressure side of the refrigerant circuit 9. The rotational torque applied to the first piston 21 in the refrigerant discharge process also serves as a part of the rotational driving force of the mechanical power recovery shaft 12. That is, the mechanical power recovery shaft 12 is rotated by the flow of high pressure refrigerant into the suction chamber 23*a* and the suction of the refrigerant in the discharge process. The rotational torque of the mechanical power recovery shaft 12 is used as mechanical power for the sub-compression mechanism 2.

As the rotational angle (θ) of the first piston 21 increases further, the refrigerant in the discharge chamber 23*b* is discharged gradually to the low pressure side of the refrigerant circuit 9. Then, when the first piston 21 reaches the top dead center again (θ=720°) as shown in S1 of FIG. 11, the discharge chamber 23*b* disappears. In synchronization with this discharge process, the suction chamber 23*a* is formed again and the next suction process is carried out. As described above, a series of processes from the start of the suction process to the end of the discharge process is completed when the first piston 21 rotates 720 degrees.

—Structure of Sub-Compression Mechanism 2—

The sub-compression mechanism 2 is disposed between the second heat exchanger 6 and the main compression mechanism 3. The sub-compression mechanism 2 is coupled to the mechanical power recovery mechanism 5 by the mechanical power recovery shaft 12. The sub-compression mechanism 2 is driven by the mechanical power recovered by the mechanical power recovery mechanism 5. The pressure of the refrigerant from the second heat exchanger 6 is raised preliminarily by the sub-compression mechanism 2, and then the refrigerant is supplied to the main compression mechanism 3.

The sub-compression mechanism 2 is not limited to a mechanism for compressing the drawn refrigerant in the working chamber and then discharging the compressed refrigerant. The sub-compression mechanism 2 may be, for example, a fluid pressure motor (also referred to as a blower) for carrying out, in a substantially continuous manner, a process in which the refrigerant is drawn from the second heat exchanger 6 and a process in which the drawn refrigerant is discharged toward the main compression mechanism 3. That is, the sub-compression mechanism 2 is not particularly limited as long as it can raise the pressure of the refrigerant drawn into the main compression mechanism 3. Hereinbelow, an example where the sub-compression mechanism 2 is constituted by a fluid pressure motor will be described.

The basic structure of the sub-compression mechanism 2 is almost the same as that of the above-mentioned mechanical power recovery mechanism 5. Specifically, the sub-compression mechanism 2 includes the first closing member 15 and the third closing member 14, as shown in FIG. 7. The first closing member 15 is a component common to the sub-compression mechanism 2 and the mechanical power recovery mechanism 5. The first closing member 15 and the third closing member 14 face each other. Specifically, the third closing member 14 faces one surface of the first closing member 15 opposite to the other surface facing the second closing member 13. A second cylinder 42 is disposed between the first closing member 15 and the third closing member 14. The second cylinder 42 has an approximately cylindrical interior space. The interior space of the second cylinder 42 is closed by the first closing member 15 and the third closing member 14.

The mechanical power recovery shaft 12 penetrates the second cylinder 42 in the axial direction thereof. The mechanical power recovery shaft 12 is disposed on the central axis of the second cylinder 42. The second piston 41 is disposed in an approximately cylindrical interior space formed by the inner peripheral surface of the second cylinder 42, the first closing member 15 and the third closing member 14. The second piston 41 is fitted to the mechanical power recovery shaft 12 in an eccentric manner with respect to the central axis of the mechanical power recovery shaft 12. Specifically, the mechanical power recovery shaft 12 includes an eccentric portion 12*c* having a central axis displaced from that of the mechanical power recovery shaft 12. The cylindrical second piston 41 is fitted to the eccentric portion 12*c*. Therefore, the second piston 41 is eccentric with respect to the central axis of the second cylinder 42. Accordingly, the second piston 41 performs an eccentric rotational motion with the rotation of the mechanical power recovery shaft 12.

The eccentric portion 12*c* on which the second piston 41 is mounted is eccentric in approximately the same direction as the eccentric portion 12*f* on which the first piston 21 is mounted. Therefore, in the present embodiment, the eccentric direction of the first piston 21 with respect to the central axis of the first cylinder 22 is approximately equal to the eccentric direction of the second piston 41 with respect to the central axis of the second cylinder 42.

Figure 10:
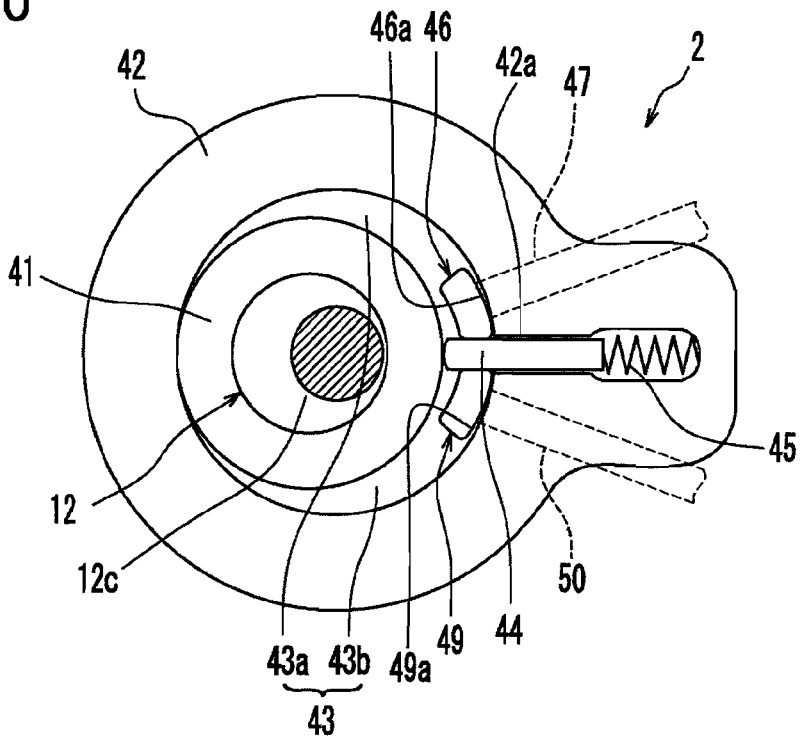
FIG. 10 is a view taken along arrows X-X in FIG. 7.

In the second cylinder 42, a second working chamber 43 is formed by the second piston 41, the inner peripheral surface of the second cylinder 42, the first closing member 15, and the third closing member 14 (see also FIG. 10).

As shown in FIG. 10, a linear groove 42*a* opening to the second working chamber 43 is formed in the second cylinder 42. A plate-like second partition member 44 is inserted slidably into the linear groove 42*a*. A biasing means 45 is disposed between the second partition member 44 and the bottom portion of the linear groove 42*a*. The second partition member 44 is pressed against the outer peripheral surface of the second piston 41 by the biasing means 45. Thereby, the second working chamber 43 is partitioned into two spaces. Specifically, the second working chamber 43 is partitioned into a low pressure side suction chamber 43*a* and a high pressure side discharge chamber 43*b*.

The biasing means 45 may be constituted by a spring, for example. Specifically, the biasing means 45 may be a compression coil spring. The biasing means 45 may be a so-called gas spring.

The suction passage 47 opens to a portion in the suction chamber 43*a* adjacent to the second partition member 44. As shown in FIG. 7, the suction passage 47 is formed in the third closing member 14 located above the second cylinder 42. The suction passage 47 communicates with the suction pipe 48.

As shown in FIG. 10, the opening (suction port) 46 of the suction passage 47 opening to the suction chamber 43*a* is formed in an approximately fan shape extending in an arc shape from the portion adjacent to the second partition member 44 in the suction chamber 43*a* toward the direction in which the suction chamber 43*a* spreads out. The suction port 46 is completely closed by the second piston 41 only when the second piston 41 is located at the top dead center. At least a part of the suction port 46 is exposed to the suction chamber 43*a* at all times except for a moment when the second piston 41 is located at the top dead center. Specifically, in plan view, the outer edge 46*a* of the suction port 46 located outside in the radial direction of the second cylinder 42 is formed in an arc shape along the outer peripheral surface of the second piston 41 located at the top dead center. In other words, the outer edge 46*a* is formed in a shape of an arc having almost the same radius as that of the outer peripheral surface of the second piston 41.

On the other hand, the discharge passage 50 opens to a portion in the discharge chamber 43*b* adjacent to the second partition member 44. As shown in FIG. 7, this discharge passage 50 also is formed in the third closing member 14, as in the case of the suction passage 47. The discharge passage 50 communicates with the discharge pipe 51. Thereby, the refrigerant in the discharge chamber 43*b* is discharged toward the main compression mechanism 3 through the discharge passage 50 and the discharge pipe 51. The refrigerant discharged to the side of the main compression mechanism 3 is supplied to the main compression mechanism 3 through the connecting pipe 70 and the suction pipe 32*c*.

The opening (discharge port) 49 of the discharge passage 50 opening to the discharge chamber 43*b* is formed in an approximately fan shape extending in an arc shape from the portion adjacent to the second partition member 44 in the discharge chamber 43*b* toward the direction in which the discharge chamber 43*b* spreads out. The discharge port 49 is completely closed by the second piston 41 only when the second piston 41 is located at the top dead center. At least a part of the discharge port 49 is exposed to the discharge chamber 43*b* at all times except for a moment when the second piston 41 is located at the top dead center. Specifically, in plan view, the outer edge 49*a* of the discharge port 49 located outside in the radial direction of the second cylinder 42 is formed in an arc shape along the outer peripheral surface of the second piston 41 located at the top dead center. In other words, the outer edge 49*a* is formed in a shape of an arc having almost the same radius as that of the outer peripheral surface of the second piston 41.

Figure 12:
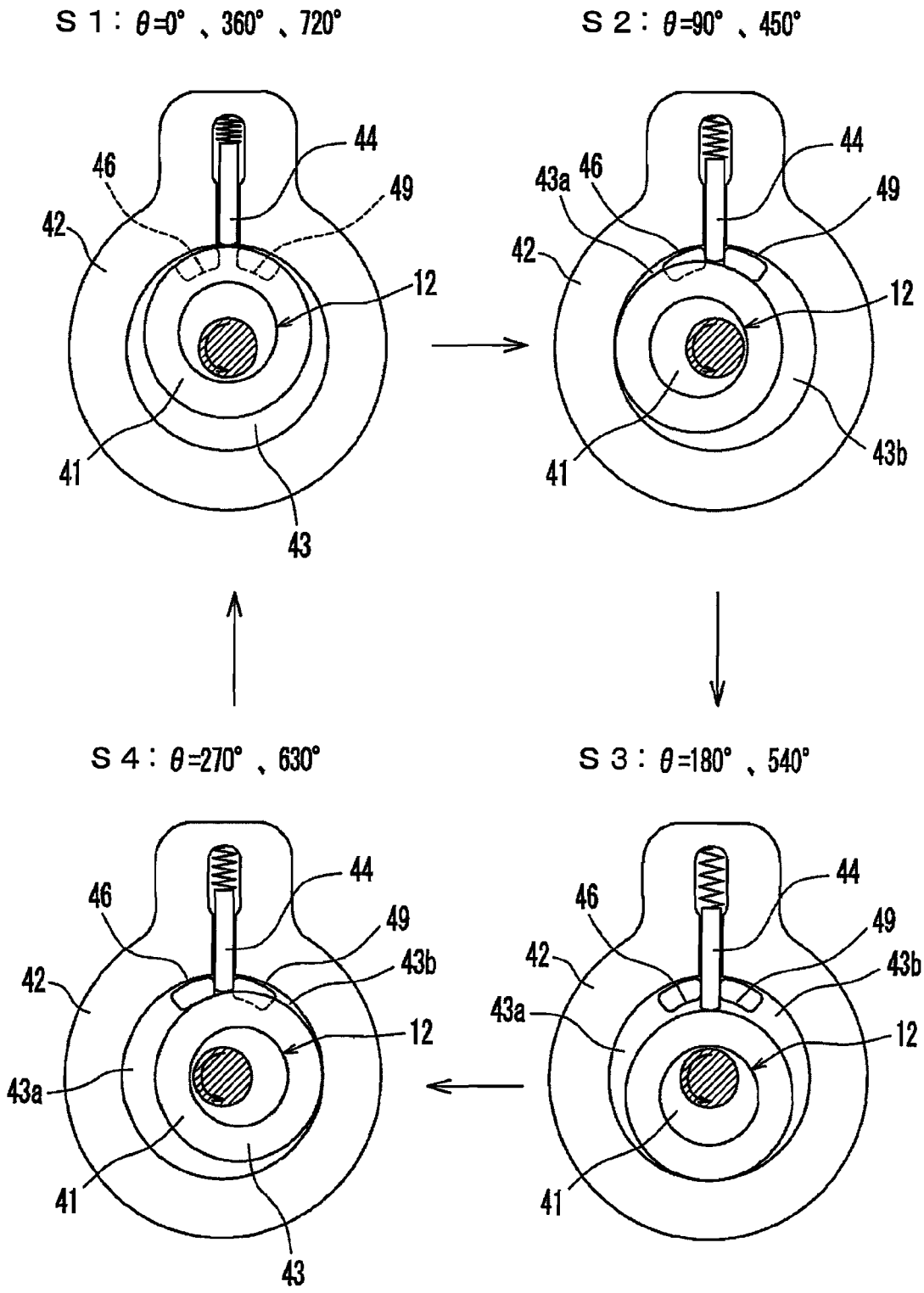
FIG. 12 is an operating principle diagram of a sub-compression mechanism.

As shown in S1 of FIG. 12, the moment when the second piston 41 is located at the top dead center is a moment when the central axis (eccentric axis) of the second piston 41 is located closest to the second partition member 44. The "moment when the second piston 41 is located at the top dead center" is not limited strictly to a moment when the second piston 41 is located at the top dead center, and it may be a certain period of time including the moment when the second piston 41 is located at the top dead center. It is assumed here that the rotational angle (θ) of the second piston 41 is 0 degree when the second piston 41 is located at the top dead center. Under this assumption, for example, a structure in which both the suction port 46 and the discharge port 49 are closed throughout a period of time during which the rotational angle (θ) of the second piston 41 is within a range of 0±5 degrees also is included in a structure in which leakage from the suction passage 47 to the discharge passage 50 does not occur.

In the case where the suction passage 47 and the discharge passage 50 are formed as described above, both the suction port 46 and the discharge port 49 are closed completely only at a moment when the second piston 41 is located at the top dead center, as shown in S1 of FIG. 12. That is, at a moment when the first working chamber 43 is present alone, both the suction port 46 and the discharge port 49 are closed completely. More specifically, the suction chamber 43*a* is in communication with the suction passage 47 up to the moment when the suction chamber 43*a* communicates with the discharge port 49. Then, after the moment when the suction chamber 43*a* communicates with the discharge passage 50 and thereby the suction chamber 43*a* shifts to the discharge chamber 43*b*, the suction port 46 is closed by the second piston 41. Therefore, the backflow of the refrigerant from the relatively high pressure discharge passage 50 to the relatively low pressure suction passage 47 is suppressed. Accordingly, highly efficient supercharging is achieved. As a result, the utilization efficiency of the recovered mechanical power is increased.

From the viewpoint of preventing completely backflow of the refrigerant from the discharge passage 50 to the suction passage 47, it is preferable that both the suction passage 47 and the discharge passage 50 are closed at the moment when the second piston 41 is located at the top dead center. Even in the case where only one of the suction port 46 and the discharge port 49 is closed at the moment when the second piston 41 is located at the top dead center, if a difference between the timing at which the suction port 46 is closed and the timing at which the discharge port 49 is closed is smaller than about 10 degrees in terms of the rotational angle of the mechanical power recovery shaft 12, the refrigerant does not flow back substantially from the discharge passage 50 to the suction passage 47. That is, by setting the difference between the timing at which the suction port 46 is closed and the timing at which the discharge port 49 is closed to be smaller than about 10 degrees in terms of the rotational angle of the mechanical power recovery shaft 12, backflow of the refrigerant from the discharge passage 50 to the suction passage 47 can be suppressed.

As described above, the suction chamber 43*a* is always in communication with the suction passage 47. The discharge chamber 43*b* is always in communication with the discharge passage 50. In other words, in the sub-compression mechanism 2, a process in which a refrigerant is drawn and a process in which the drawn refrigerant is discharged are carried out in a substantially continuous manner. Therefore, the drawn refrigerant passes through the sub-compression mechanism 2 without changing its volumetric capacity substantially.

—Operation of Sub-Compression Mechanism 2—

Next, the operating principle of the sub-compression mechanism 2 will be described in detail with reference to FIG. 12. S1 of FIG. 12 shows a state in which the rotational angle (θ) of the second piston 41 is 0, 360 and 720 degrees. S2 of FIG. 12 shows a state in which the rotational angle (θ) of the second piston 41 is 90 and 450 degrees. S3 of FIG. 12 shows a state in which the rotational angle (θ) of the second piston 41 is 180 and 540 degrees. S4 of FIG. 12 shows a state in which the rotational angle (θ) of the second piston 41 is 270 and 630 degrees. In FIG. 12, a counterclockwise direction is indicated as a positive direction of the rotational angle (θ).

As described above, the mechanical power recovery shaft 12 is rotated by the mechanical power recovered by the mechanical power recovery mechanism 5. With the rotation of the mechanical power recovery shaft 12, the second piston 41 also rotates, and thereby the sub-compression mechanism 2 is driven.

As shown in S1 of FIG. 12, when the second piston 41 is located at the top dead center (θ=0°), both the suction port 46 and the discharge port 49 are closed by the second piston 41. Therefore, the second working chamber 43 is not in communication with either the suction passage 47 or the discharge passage 30 and is in an isolated state.

As the second piston 41 rotates from this state, the suction chamber 43*a* communicating with the suction passage 47 is formed. As the rotational angle (θ) of the second piston 41 increases to 360 degrees, the suction chamber 43*a* expands. When the rotational angle (θ) reaches 360 degrees, the refrigerant suction process is completed.

The suction chamber 43*a* is always in communication with the suction passage 47 until the rotational angle (θ) reaches 360 degrees. When the rotational angle (θ) reaches 360 degrees, the suction passage 47 is closed by the second piston 41. When the rotational angle (θ) is 360 degrees, the discharge passage 50 also is closed. That is, the second working chamber 43 is separated and isolated from both the suction passage 47 and the discharge passage 50. When the rotational angle (θ) exceeds 360 degrees with the rotation thereof, the second working chamber 43 communicates with the discharge passage 50 and shifts to the discharge chamber 43*b*. As the rotational angle (θ) of the second piston 41 exceeds 360 degrees and increases further, the volumetric capacity of the discharge chamber 43*b* decreases. With the decrease in the volumetric capacity of the discharge chamber 43*b*, the refrigerant is discharged therefrom toward the main compression mechanism 3. Then, as shown in S1 of FIG. 12, when the second piston 41 reaches the top dead center again (θ=720°) as shown in S1 of FIG. 12, the discharge chamber 43*b* disappears. The discharge chamber 43*b* is always in communication with the discharge passage 50 throughout the entire discharge process. Then, in synchronization with this discharge process, the suction chamber 43*a* is formed again and the next suction process is carried out. As described above, a series of processes from the start of the suction process to the end of the discharge process is completed when the second piston 41 rotates 720 degrees.

As described above, the volumetric capacity of the second working chamber 43 does not change substantially. In addition, the suction chamber 43*a* is always in communication with the suction passage 47. The discharge chamber 43*b* is always in communication with the discharge passage 50. Therefore, the refrigerant is neither compressed nor expanded in the second working chamber 43 of the sub-compression mechanism 2. Since the mechanical power recovery shaft 12 is rotated by the mechanical power recovery mechanism 5 and thereby the sub-compression mechanism 2 is driven, with the driving of the sub-compression mechanism 2, the pressure on the downstream side of the second working chamber 43 becomes higher than that on the upstream side thereof. In other words, since the sub-compression mechanism 2 is driven by the mechanical power recovered by the mechanical power recovery mechanism 5, the pressure on the downstream side from the discharge port 49 closer to the main compression mechanism 3 is higher than the pressure on the upstream side from the suction port 46 closer to the second heat exchanger 6. That is, the sub-compression mechanism 2 raises the pressure of the refrigerant.

In the present embodiment, the timing when the first piston 21 of the mechanical power recovery mechanism 5 is located at the top dead center is approximately identical to the timing when the second piston 41 of the sub-compression mechanism 2 is located at the top dead center.

<Functions and Effects>

As described above, the heat-insulating structure 80*e* has the peripheral portion 91 in which the interior space 95 including the first interior space 93 and the second interior space 94 is formed. Therefore, as shown in FIG. 6, it is possible to keep the high temperature part 11*c* of the closed casing 11 adjacent to the upper portion 16*a* in which relatively high temperature refrigerating machine oil is contained separated from the low temperature part 11*d* of the closed casing 11 adjacent to the lower portion 16*b* in which relatively low temperature refrigerating machine oil is contained. In other words, a medium temperature part 11*e* facing the interior space 87 can be provided between the high temperature part 11*c* and the low temperature part 11*d*. Thereby, heat transfer from the high temperature part 11*c* to the low temperature part 11*d* can be suppressed. As a result, heat transfer between the upper portion 16*a* and the lower portion 16*b*, which occurs via the closed casing 11, can be suppressed. Accordingly, heat transfer between the main compression mechanism 3 and the mechanical power recovery mechanism 5 can be suppressed more effectively. As a result, the COP of the refrigeration cycle apparatus 1 can be improved further.

In the fourth embodiment, the interior space 92 for spacing the plate portion 89 apart from the plate portion 88 is formed in the heat-insulating structure 80*e*. Therefore, the thermal conductivity of the heat-insulating structure 80*e* is lower than that of the heat-insulating structure 80*a* of the above first embodiment. The distance between the upper portion 16*a* and the lower portion 16*b* is relatively large. Accordingly, the heat-insulating structure 80*e* serves as an effective thermal barrier, which suppresses more effectively the heat transfer between the upper portion 16*a* and the lower portion 16*b*.

Preferably, the thermal conductivity of the interior space 92 is lower than that of refrigerating machine oil. Thereby, heat transfer between the upper portion 16*a* and the lower portion 16*b* can be suppressed particularly effectively.

Since the relatively high temperature main compression mechanism 3 is disposed in the upper part of the closed casing 11, the temperature of the closed casing 11 is high in the upper part thereof and decreases toward the lower part. Therefore, the mechanical power recovery mechanism 5 disposed below the sub-compression mechanism 2 is fixed to the closed casing 11, as in the fourth embodiment, and thereby heat transfer between the closed casing 11 and the mechanical power recovery mechanism 5 can be suppressed. As a result, heat transfer between the main compression mechanism 3 and the mechanical power recovery mechanism 5 also is suppressed, and the COP of the refrigeration cycle apparatus 1 is improved as well.

In the fourth embodiment, the sub-compression mechanism 2 and the mechanical power recovery mechanism 5 each are constituted by a fluid pressure motor having a relatively simple structure. Therefore, the configuration of the fluid machine 10 can be simplified and downsized further. As a result, the refrigeration cycle apparatus 1 can be simplified and downsized further, and manufactured at lower cost. From the viewpoints of simplification, downsizing and cost reduction, it is particularly preferable that the sub-compression mechanism 2 and the mechanical power recovery mechanism 5 each are a rotary-type fluid pressure motor.

Furthermore, by downsizing the sub-compression mechanism 2 and the mechanical power recovery mechanism 5, the capacity of the oil reservoir 16 can be reduced. Thereby, the amount of refrigerating machine oil that can be contained in the oil reservoir 16 also can be reduced. As a result, the height of the oil level in the oil reservoir 16 can be kept more constant. Accordingly, the refrigerating machine oil can be supplied more reliably to the main compression mechanism 3, as well as the sub-compression mechanism 2 and the mechanical power recovery mechanism 5.

Moreover, the sub-compression mechanism 2 and the mechanical power recovery mechanism 5 each are constituted by a fluid pressure motor, and thereby both the waveform of the torque recovered by the mechanical power recovery mechanism 5 and the waveform of the load torque of the sub-compression mechanism 2 can be approximately sinusoidal ones, whose cycle corresponds to the rotational angle of 360 degrees of the mechanical power recovery shaft 12. As a result, the mechanical power recovery shaft 12 rotates smoothly without slowing down the rotation speed. Therefore, the energy recovery efficiency can be increased. In addition, vibration and noise that may occur in the refrigeration cycle apparatus 1 can be suppressed.

Specifically, the timing when the first piston 21 of the mechanical power recovery mechanism 5 is located at the top dead center is synchronized with the timing when the second piston 41 of the sub-compression mechanism 2 is located at the top dead center, and thereby the waveform of the load torque can coincide with the waveform of the recovered torque. In other words, at any rotational angle of the mechanical power recovery shaft 12, the ratio between the load torque and the recovered torque is constant substantially. Accordingly, variations in the rotational speed of the shaft can be reduced. As a result, the energy efficiency of the refrigeration cycle apparatus 1 can be increased further. In addition, since the variations in the rotational speed of the shaft can be reduced, vibration and noise in the refrigeration cycle apparatus 1 also can be suppressed.

More specifically, in the fourth embodiment, the direction in which the first partition member 24 is disposed with respect to the mechanical power recovery shaft 12 coincides approximately with the direction in which the second partition member 44 is disposed with respect to the mechanical power recovery shaft 12, and the eccentric direction of the first piston 21 with respect to the central axis of the first cylinder 22 coincides approximately with the eccentric direction of the second piston 41 with respect to the central axis of the second cylinder 42. Thereby, the timing when the first piston 21 of the mechanical power recovery mechanism 5 is located at the top dead center is synchronized with the timing when the second piston 41 of the sub-compression mechanism 2 is located at the top dead center. Such a configuration facilitates the manufacture of the fluid machine 10.

Furthermore, since the eccentric direction of the first piston 21 with respect to the central axis of the first cylinder 22 coincides approximately with the eccentric direction of the second piston 41 with respect to the central axis of the second cylinder 42, a friction force generated between the mechanical power recovery shaft 12, and the second closing members 13 and the third closing members 14 that support pivotally the mechanical power recovery shaft 12 can be reduced.

Specifically, a differential pressure force in the direction from the relatively high pressure suction chamber 23*a* toward the relatively low pressure discharge chamber 23*b* acts on the first piston 21 of the mechanical power recovery mechanism 5. Likewise, a differential pressure force in the direction from the relatively high pressure discharge chamber 43*b* toward the relatively low pressure suction chamber 43*a* acts on the second piston 41 of the sub-compression mechanism 2. These differential pressure forces press the mechanical power recovery shaft 12 via the eccentric portions 12*f* and 12*c*, and affect the bearing portions of the second and third closing members 13 and 14 that support pivotally the mechanical power recovery shaft 12. Therefore, if these differential pressure forces are in the same direction, a rotation inhibiting force is applied to the mechanical power recovery shaft 12, which accelerates the abrasion of the mechanical power recovery shaft 12 as well as the abrasion of the bearing portions. In contrast, in the fourth embodiment, the direction of the differential pressure force that acts on the first piston 21 is opposite to the direction of the differential pressure force that acts on the second piston 41. Therefore, the differential pressure forces that acts on the first piston 21 and the second piston 41 cancel each other. As a result, the friction force generated between the mechanical power recovery shaft 12, and the second closing members 13 and the third closing members 14 can be reduced. Accordingly, the mechanical power required for rotating the mechanical power recovery shaft 12 can be reduced, and thereby the energy recovery can be increased. In addition, the friction generated between the mechanical power recovery shaft 12, and the second closing members 13 and the third closing member 14 can be reduced.

Furthermore, since the mechanical power recovery mechanism 5 and the sub-compression mechanism 2 use the first closing member 15 in common, as in the fourth embodiment, not only the fluid machine 10*e* but also the refrigeration cycle apparatus 1 can be made compact.

Fifth Embodiment

Figure 13:
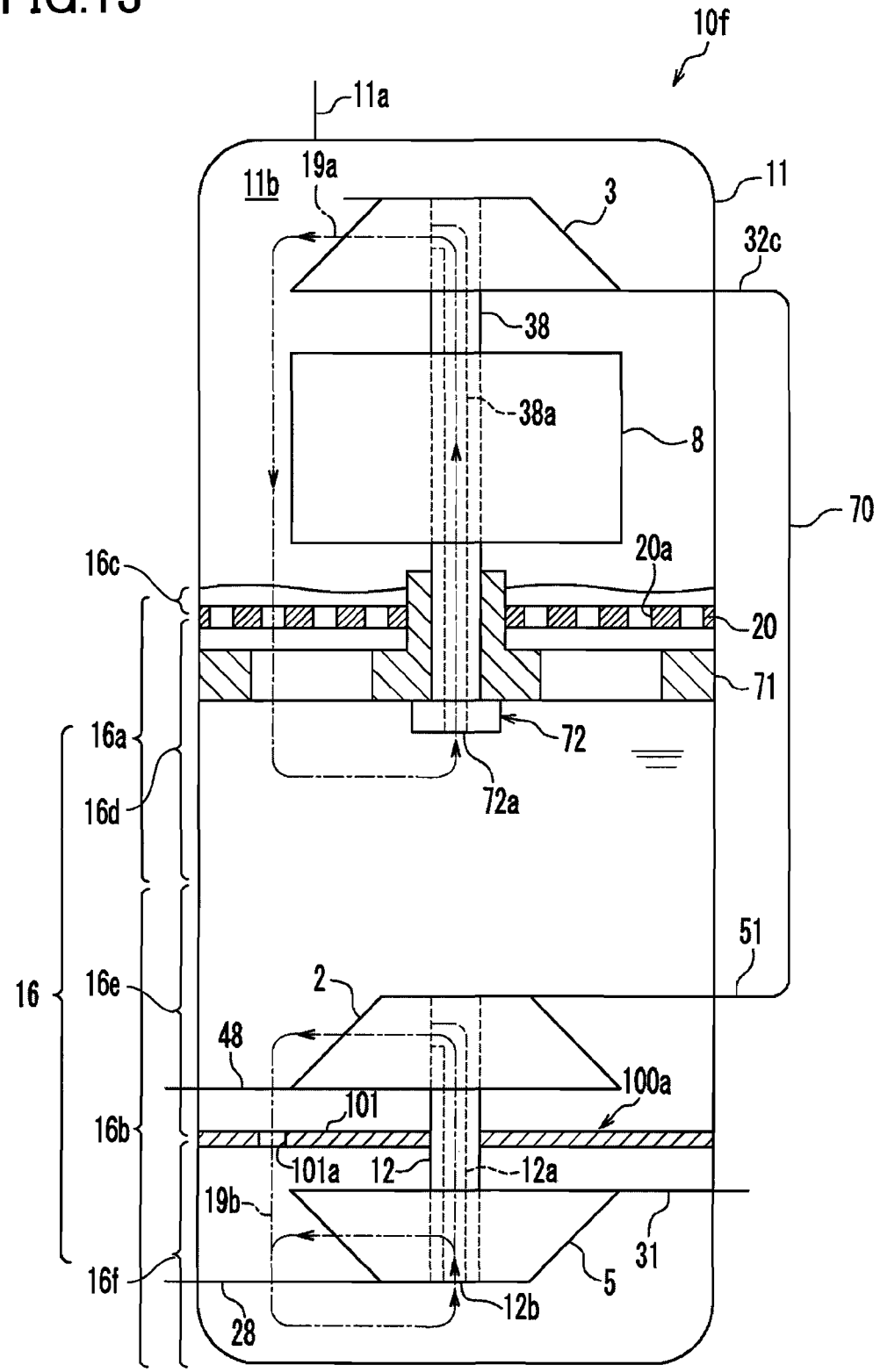
FIG. 13 is a cross-sectional view of a fluid machine in a fifth embodiment.

FIG. 13 is a schematic configuration diagram of a fluid machine 10*f* according to a fifth embodiment. Hereinafter, the configuration of the fluid machine 10*f* according to the fifth embodiment will be described with reference to FIG. 13, etc. The fifth embodiment will be described also with reference to FIG. 1, as in the first embodiment. Hereinbelow, components having substantially the same functions as those of the first embodiment are denoted by the same reference numerals, and a description thereof will be omitted.

In the above first embodiment, the example where the heat-insulating structure 80*a* is disposed between the upper portion 16*a* and the lower portion 16*b*, as shown in FIG. 2, has been described. In contrast, in the fifth embodiment, a heat-insulating structure 100*a*, in place of the heat-insulating structure 80*a*, is provided between the first lower portion 16*e* and the second lower portion 16*f*, as shown in FIG. 13, and this heat-insulating structure 100*a* separates the first lower portion 16*e* and the second lower portion 16*f*. That is, the heat-insulating structure 100*a* is disposed between the sub-compression mechanism 2 and the mechanical power recovery mechanism 5. The heat-insulating structure 100*a* has substantially the same structure as the heat-insulating structure 80*a*, and is constituted by a plate member 101 provided with one or more openings 101*a*.

The upper portion 16*a* and the lower portion 16*b* do not necessarily have to be separated from each other by a structural component. In this case, the upper portion 16*a* is a part above a level that is slightly above the expansion mechanism 5 and the sub-compression mechanism 2 in the oil reservoir 16, and the lower portion 16*b* is the rest of the oil reservoir 16.

By disposing the heat-insulating structure 100*a* between the first lower portion 16*e* and the second lower portion 16*f*, as in the fifth embodiment, heat transfer between the main compression mechanism 3 and the mechanical power recovery mechanism 5 also can be suppressed because the heat-insulating structure 100*a* restricts the flow of the refrigerating machine oil between the upper portion 16*a* and the first lower portion 16*e*, and the second lower portion 16*f*. As a result, the COP of the refrigeration cycle apparatus 1 can be increased.

Unlike the mechanical power recovery mechanism 5, it does not much matter even if the temperature of the sub-compression mechanism 2 increases slightly. When heat transfer occurs between the main compression mechanism 3 and the sub-compression mechanism 2, the energy imparted to the refrigerant in the main compression mechanism 3 decreases by the amount of transferred heat, while the temperature of the refrigerant discharged from the sub-compression mechanism 2 increases by the amount of heat transferred to the sub-compression mechanism 2. In other words, the energy imparted to the refrigerant in the main compression mechanism 3 decreases, but the energy imparted to the refrigerant in the sub-compression mechanism 2 increases, and as a result, the higher temperature refrigerant is supplied to the main compression mechanism 3. That is, even if heat transfer occurs from the main compression mechanism 3 to the sub-compression mechanism 2, the decrease in the energy imparted to the refrigerant by the main compression mechanism 3 is offset substantially by the increase in the energy imparted to the refrigerant by the sub-compression mechanism 2. Therefore, the COP of the refrigeration cycle apparatus 1 does not decrease so much.

Figure 14:
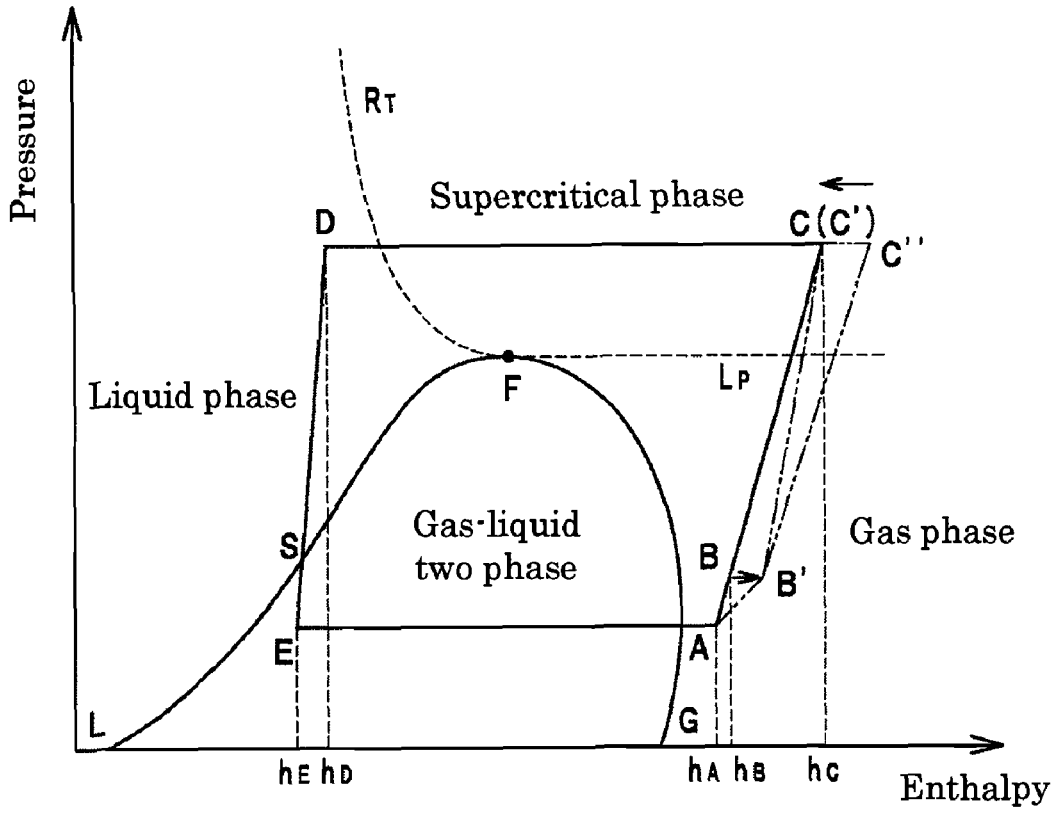
FIG. 14 is a Mollier diagram of a refrigeration cycle in the fifth embodiment.

As a specific example, a case where A-B and C-D in each of the four-way valves 17 and 18 are connected will be described in more detail with reference to the refrigeration cycle shown in FIG. 14. Specifically, the refrigeration cycle (A-B-C-D-E) drawn in full line in FIG. 14 is the refrigeration cycle of the refrigeration cycle apparatus 1 when it is assumed that heat exchange does not occur between the main compression mechanism 3 and the sub-compression mechanism 2. On the other hand, the refrigeration cycle (A-B'-C'-D'-E) in FIG. 14 is the refrigeration cycle of the refrigeration cycle apparatus 1 when it is assumed that heat exchange occurs between the main compression mechanism 3 and the sub-compression mechanism 2. A-B(B') indicates a change in the state of the refrigerant in the sub-compression mechanism. B(B')-C(C') indicates a change in the state of the refrigerant in the main compression mechanism 3. C(C')-D indicates a change in the state of the refrigerant in the first heat exchanger 4 as a gas cooler. D-E indicates a change in the state of the refrigerant in the mechanical power recovery mechanism 5. E-A indicates a change in the state of the refrigerant in the second heat exchanger 6 as an evaporator.

In FIG. 14, a point F is a critical point. F-L is a saturated liquid line. F-G is a saturated gas line. $L_P$ is a constant pressure line passing through a critical point F. $R_T$ is a constant temperature line passing through the critical point F. In the Mollier diagram shown in FIG. 14, a region on the right side of the saturated gas line F-G and below the constant pressure line $L_P$ is a gas phase. A region on the left side of the saturated liquid line F-L and below the constant temperature line $R_T$ is a liquid phase. A region above the constant pressure line $L_P$ and above the constant temperature line $R_T$ is a supercritical phase. A region on the right side of the saturated liquid line F-L and on the left side of the saturated gas line F-G is a gas-liquid two phase. In FIG. 14, $h_A$, $h_B$, $h_C$, $h_D$, and $h_E$ indicate the enthalpies of the refrigerant at the points A, B, C, D, and E, respectively.

When heat transfer occurs between the main compression mechanism 3 and the sub-compression mechanism 2, the temperature of the sub-compression mechanism 2, which has been relatively low, increases. Thereby, the increased amount of energy is imparted to the refrigerant by the sub-compression mechanism 2 according to the increase in the temperature of the sub-compression mechanism 2. Therefore, the point B' is located at a higher enthalpy side than the point B.

Assuming here that the temperature of the main compression mechanism 3 does not change and the amount of energy imparted to the refrigerant by the main compression mechanism 3 also does not change, the refrigerant is compressed by the main compression mechanism 3 up to the point C". In reality, however, the temperature of the main compression mechanism 3 decreases by an increased amount of temperature of the sub-compression mechanism 2. Therefore, the amount of energy imparted to the refrigerant by the main compression mechanism 3 is decreased by a decreased amount of temperature of the main compression mechanism 3. As a result, the points C' and C are located at substantially the same position, as shown in FIG. 14. Accordingly, the energy imparted to the refrigerant by the main compression mechanism 3 and the sub-compression mechanism 2 in the case where heat transfer occurs between the main compression mechanism 3 and the sub-compression mechanism 2 is approximately equal to the energy imparted to the refrigerant by the main compression mechanism 3 and the sub-compression mechanism 2 in the case where heat transfer does not occur between the main compression mechanism 3 and the sub-compression mechanism 2. Therefore, even if heat transfer occurs between the main compression mechanism 3 and the sub-compression mechanism 2, the COP of the refrigeration cycle apparatus 1 does not decrease so much.

Sixth Embodiment

Figure 15:
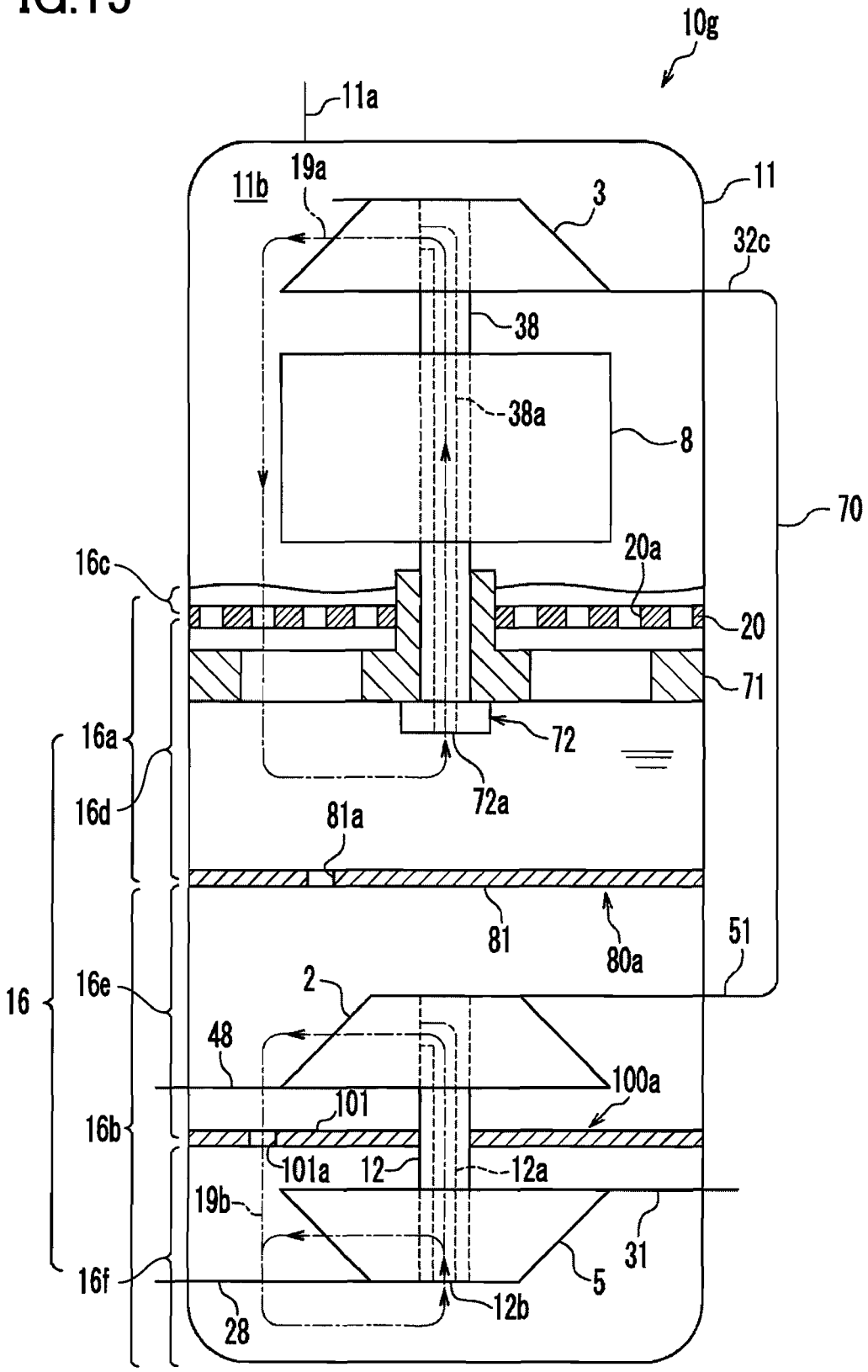
FIG. 15 is a cross-sectional view of a fluid machine in a sixth embodiment.

FIG. 15 is a schematic configuration diagram of a fluid machine 10*g* according to a sixth embodiment. Hereinafter, the configuration of the fluid machine 10*g* according to the sixth embodiment will be described with reference to FIG. 15. The sixth embodiment will be described also with reference to FIG. 1, as in the first embodiment. Hereinbelow, components having substantially the same functions as those of the first embodiment are denoted by the same reference numerals, and a description thereof will be omitted.

In the fluid machine 10*g* according to the sixth embodiment, both the heat-insulating structure 80*a* described in the above first embodiment and the heat-insulating structure 100*a* described in the above fifth embodiment are disposed. Therefore, heat transfer between the main compression mechanism 3 and the mechanical power recovery mechanism 5 is suppressed particularly effectively. As a result, the COP of the refrigeration cycle apparatus 1 also is improved further.

The heat-insulating structure 100*a* may have the same structure as, for example, the heat-insulating structure 80*b* shown in FIG. 3. The heat-insulating structure 100*a* may have the same structure as, for example, the heat-insulating structure 80*c* shown in FIGS. 4 and 5. The heat-insulating structure 100*a* may have the same structure as, for example, the heat-insulating structure 80*e* shown in FIG. 6. Furthermore, the heat-insulating structure 80*b* shown in FIG. 3, the heat-insulating structure 80*c* shown in FIGS. 4 and 5, or the heat-insulating structure 80*e* shown in FIG. 6 may be provided in place of the heat-insulating structure 80*a*.

From the viewpoint of reducing heat transfer between the main compression mechanism 3 and the mechanical power recovery mechanism 5, it is most preferable to use the heat-insulating structure 100*a* having the same structure as the heat-insulating structure 80*e* shown in FIG. 6 and to provide the heat-insulating structure 80*e* shown in FIG. 6 in place of the heat-insulating structure 80*a*.

<<Second Modification>>

Figure 16:
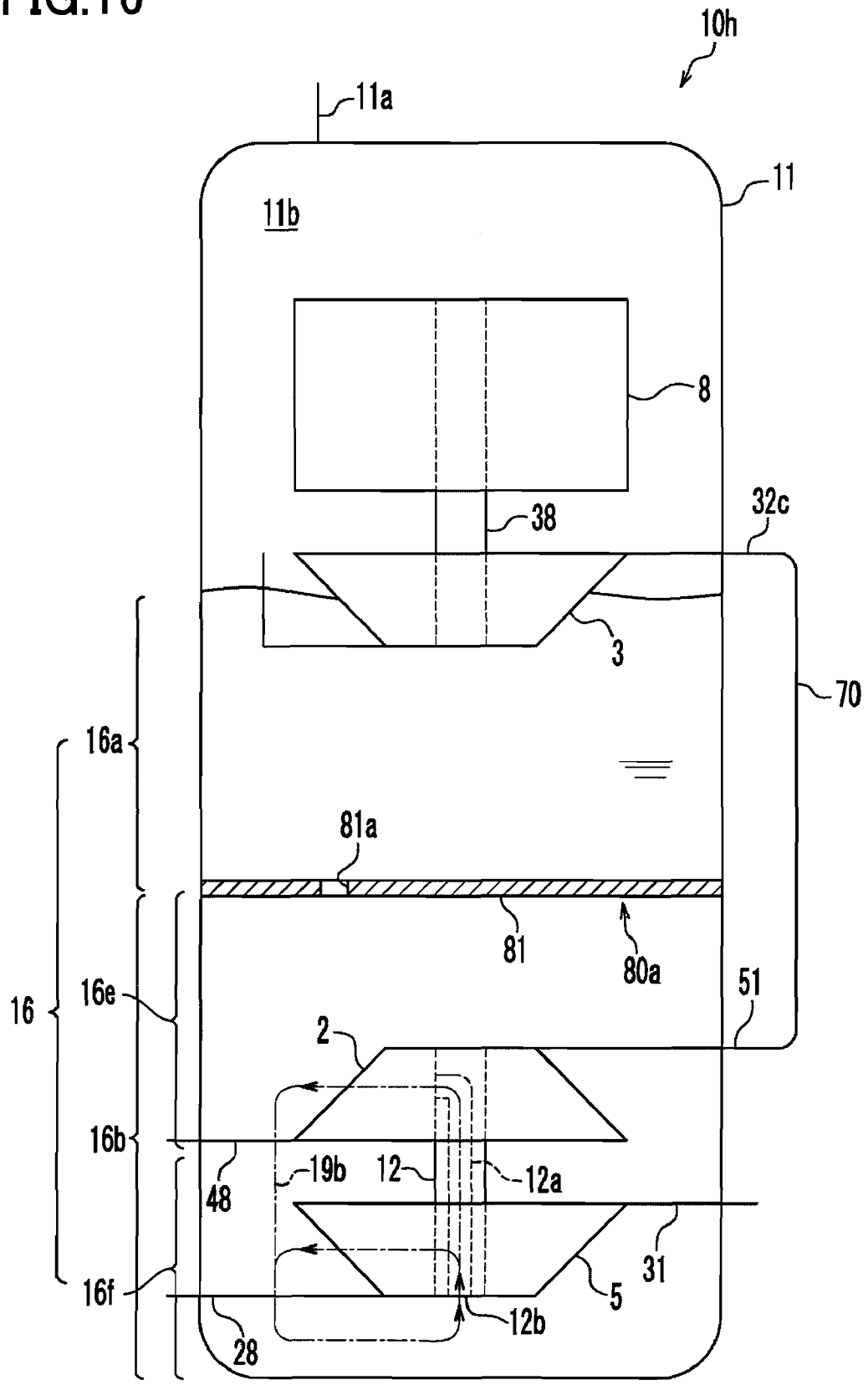
FIG. 16 is a cross-sectional view of a fluid machine in a second modification.

In each of the above first to sixth embodiments, the example where the refrigerating machine oil is supplied to the main compression mechanism 3 using the oil pump 72 has been described. However, the present invention is not limited to this configuration. For example, the main compression mechanism 3 may be immersed directly in the oil reservoir 16 without providing the oil pump 72, as shown in FIG. 16, so as to supply the refrigerating machine oil to the main compression mechanism 3. In the case where the main compression mechanism 3 is immersed directly in the oil reservoir 16, it is preferable that the main compression mechanism 3 is a rotary-type compression mechanism having a relatively simple structure.

<<Third Modification>>

Figure 17:
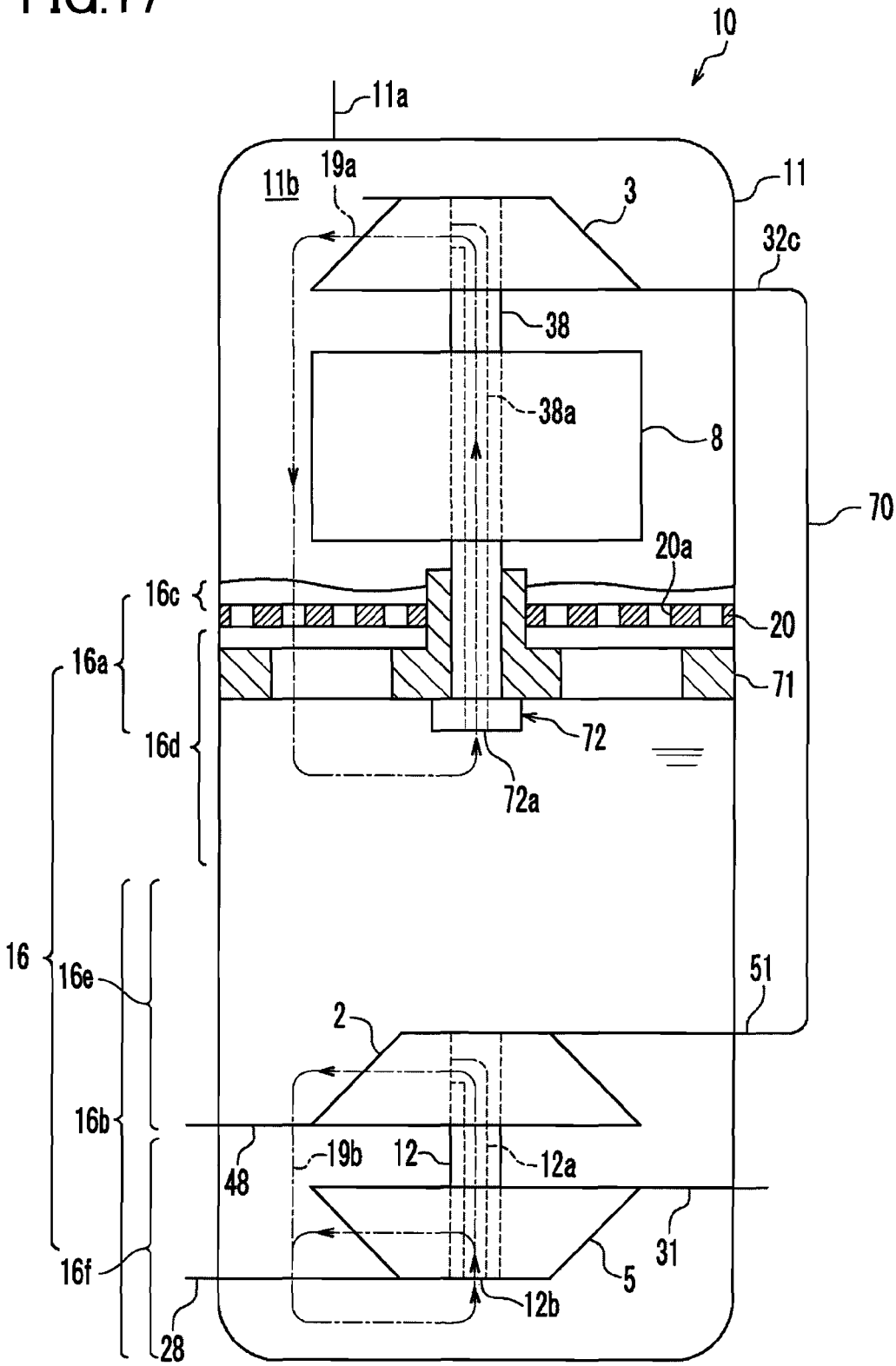
FIG. 17 is a cross-sectional view of a fluid machine in a third modification.
Figure 18:
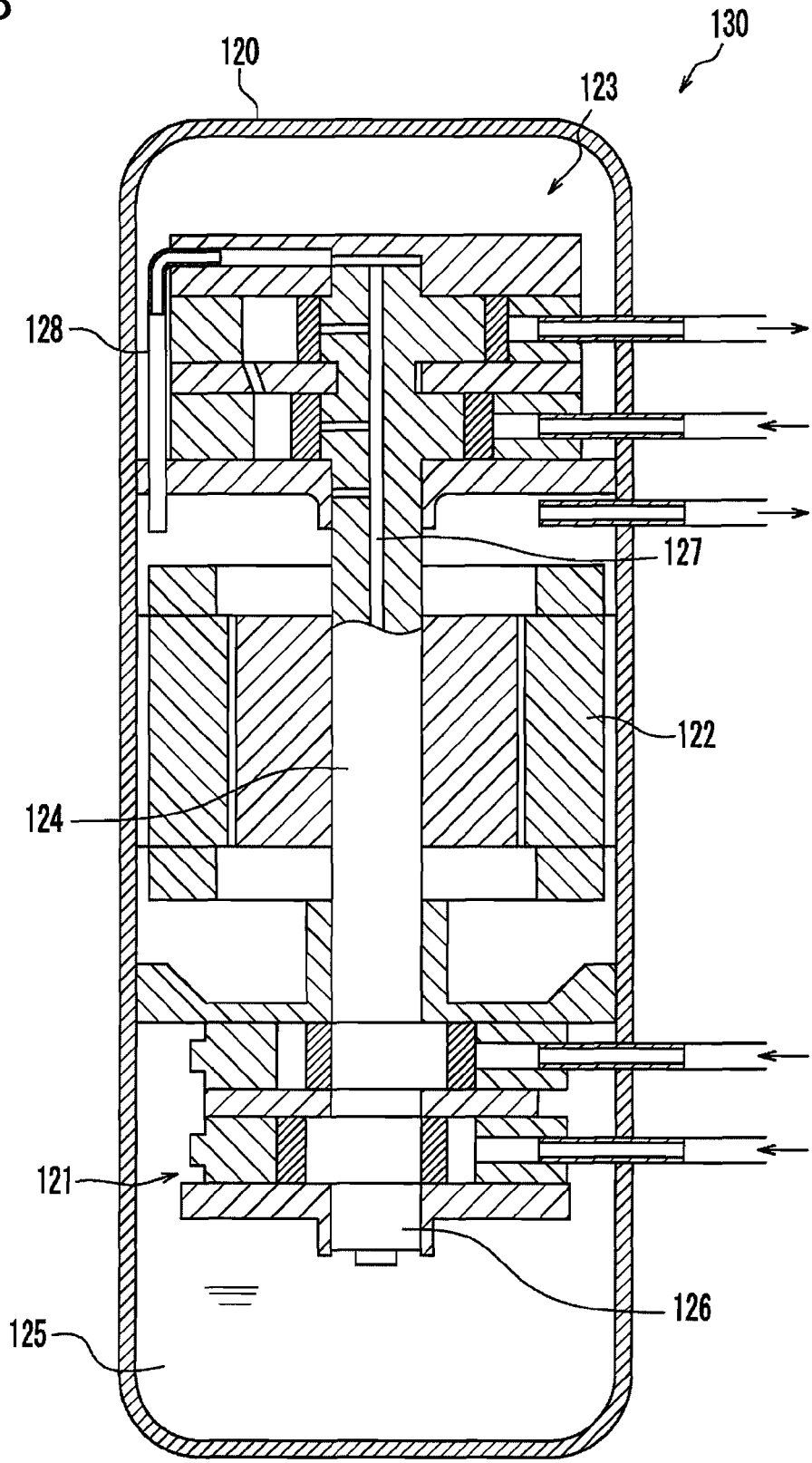
FIG. 18 is a cross-sectional view of an expander-compressor unit described in JP 2005-299632 A.

In the above first embodiment, the example where the heat-insulating structure 80*a* is disposed between the upper portion 16*a* and the mechanical power recovery mechanism 5, as shown in FIG. 2, has been described. The heat-insulating structure 80*a*, however, is not essential in the present invention. For example, as shown in FIG. 17, the present invention may be configured without the heat-insulating structure 80*a*.

<<Other Modifications>>

In each of the above embodiments, the example where the mechanical power recovery mechanism 5 is disposed below the sub-compression mechanism 2 has been described. However, the present invention is not limited to this configuration. For example, the mechanical power recovery mechanism 5 may be disposed above the sub-compressor.

In the above fourth embodiment, the example where the main compression mechanism 3 is a scroll-type compression mechanism has been described. In the present invention, the main compression mechanism 3 is not limited to a scroll-type compression mechanism. In the present invention, the main compression mechanism 3 may be, for example, a rotary-type compression mechanism.

In the above first embodiment, the example where the oil pump 72 is located in the second upper portion 16*d*, as shown in FIG. 2, has been described. In other words, the example where the refrigerating machine oil in the second upper portion 16*d* is supplied to the main compression mechanism 3 has been described. The present invention, however, is not limited to this configuration. For example, the oil pump 72 may be disposed in the first upper portion 16*c*. In other words, the refrigerating machine oil in the first upper portion 16*c* may be supplied to the main compression mechanism 3.

In the above fourth embodiment, the example where the interior space 92 is formed between the plate portion 89 and the plate portion 88 has been described. The present invention, however, is not limited to this configuration. The interior space 92 may not necessarily be formed between the plate portion 88 and the plate portion 89. That is, the plate portion 89 and the plate portion 88 may be arranged closely in contact with each other. In other words, the plate portion 89 and the plate portion 88 may constitute one plate portion. That is, only one of the plate portion 89 and the plate portion 88 may be provided.

In the above fourth embodiment, the example where the mechanical power recovery mechanism 5 disposed below the sub-compression mechanism 2 is fixed to the closed casing 11 has been described. The present invention, however, is not limited to this configuration. For example, the sub-compression mechanism 2 may be fixed to the closed casing 11. This makes it possible to suppress heat transfer between the closed casing 11 and the mechanical power recovery mechanism 5. This is because direct heat transfer between the closed casing 11 and the mechanical power recovery mechanism 5 is suppressed.

In the above fourth embodiment, the example where the interior space 95 includes both the first interior space 93 located above the plate portion 89 on the side of the upper portion 16*a* and the second interior space 94 located below the plate portion 88 on the side of the lower portion 16*b* has been described. The present invention, however, is not limited to this configuration. For example, the interior space 95 may include only one of the first interior space 93 located above the plate portion 89 on the side of the upper portion 16*a* and the second interior space 94 located below the plate portion 88 on the side of the lower portion 16*b*. Even in the case where the interior space 95 includes only one of the first interior space 93 and the second interior space 94, heat transfer between the upper portion 16*a* and the lower portion 16*b*, which occurs via the closed casing 11, can be suppressed. Accordingly, the heat transfer between the main compression mechanism 3 and the mechanical power recovery mechanism 5 can be suppressed more effectively.

In each of the above fifth and sixth embodiments, the example where the heat-insulating structure 100*a* is constituted by the plate member 101 has been described. However, the heat-insulating structure 100*a* is not limited to this structure. For example, the heat-insulating structure 100*a* may have the same structure as, for example, the heat-insulating structure 80*b* shown in FIG. 3. The heat-insulating structure 100*a* may have the same structure as, for example, the heat-insulating structure 80*c* shown in FIGS. 4 and 5. The heat-insulating structure 100*a* may have the same structure as, for example, the heat-insulating structure 80*e* shown in FIG. 6.

The heat-insulating structure 80*b* shown in FIG. 3, the heat-insulating structure 80*c* shown in FIGS. 4 and 5, or the heat-insulating structure 80*e* shown in FIG. 6 may be provided in place of the heat-insulating structure 80*a* in the above sixth embodiment. An additional heat-insulating structure may be provided.

From the viewpoint of making the fluid machine 10 compact, all the suction passage 27, the discharge passage 30, the suction passage 47 and the discharge passage 50 may be formed in the first closing member 15.

The refrigerant circuit 9 may be filled with a refrigerant that is not brought into a supercritical pressure state on the high pressure side. Specifically, the refrigerant circuit 9 may be filled with a fluorocarbon refrigerant.

The example where the refrigerant circuit 9 includes the main compression mechanism 3, the first heat exchanger 4, the mechanical power recovery mechanism 5, the second heat exchanger 6 and the sub-compression mechanism 2 has been described, but the refrigerant circuit 9 may include components other than the above components.

In each of the above embodiments and modifications, the example where both the mechanical power recovery mechanism 5 and the sub-compression mechanism 2 each are constituted by a fluid pressure motor has been described. The present invention, however, is not limited to this configuration. For example, the mechanical power recovery mechanism 5 may be constituted by an expansion mechanism. The sub-compression mechanism 2 may be constituted by a compression mechanism in which a refrigerant is compressed in a working chamber.

Definition of Terms in the Present Specification

In the present specification, "refrigerating machine oil" includes not only mineral oil but also synthetic oil.

A "fluid pressure motor" refers to a mechanism for carrying out, in a substantially continuous manner, a suction process in which a refrigerant is drawn and a discharge process in which the drawn refrigerant is discharged. Specifically, in the fluid pressure motor, there is substantially no period of time during which both the suction passage and the discharge passage for the refrigerant are closed. In other words, in the fluid pressure motor, at least one of the suction passage and the discharge passage for the refrigerant is opened substantially at all times. Here, "there is substantially no period of time during which both a suction passage and a discharge passage are closed" is a concept including a case where both the suction passage and the discharge passage are closed for a moment to the extent that torque fluctuations are not generated.

The main compression mechanism 3 is not particularly limited as long as it can compress a refrigerant. The main compression mechanism 3 may be, for example, a scroll-type compression mechanism. The main compression mechanism 3 may be, for example, a rotary-type compression mechanism.

An "upper portion of an oil reservoir" refers to a portion on and above a heat-insulating structure in the case where the heat-insulating structure is disposed above an expansion mechanism and a sub-compression mechanism in the oil reservoir.

INDUSTRIAL APPLICABILITY

The present invention is useful for a refrigeration cycle apparatus.

The invention claimed is:

1. A fluid machine comprising:

a closed casing having, in its bottom portion, an oil reservoir for containing oil;

a main compression mechanism for compressing a working fluid, the main compression mechanism being disposed in the closed casing and supplied with oil contained in an upper portion of the oil reservoir;

a rotation motor disposed above the oil reservoir in the closed casing and including a rotor and a stator;

a main compression mechanism side shaft for coupling the main compression mechanism and the rotation motor so that the main compression mechanism is driven by the rotation motor;

a mechanical power recovery mechanism for recovering mechanical power from the working fluid by carrying out at least a suction process in which the working fluid is drawn and a discharge process in which the drawn working fluid is discharged, the mechanical power recovery mechanism being disposed below the upper portion in the oil reservoir;

a sub-compression mechanism for compressing the working fluid and discharging the compressed working fluid toward the main compression mechanism, the sub-compression mechanism being disposed below the upper portion in the oil reservoir;

a mechanical power recovery shaft for coupling the mechanical power recovery mechanism and the sub-compression mechanism so that the sub-compression mechanism is driven by the mechanical power recovered by the mechanical power recovery mechanism; and at least one heat-insulating structure located between the upper portion and the mechanical power recovery mechanism so as to restrict flow of oil between the upper portion of the oil reservoir and a lower portion of the oil reservoir in which the mechanical power recovery mechanism is provided.

2. The fluid machine according to claim 1, wherein the at least one heat-insulating structure is disposed separately from the mechanical power recovery mechanism and the sub-compression mechanism.

3. The fluid machine according to claim 1, wherein the mechanical power recovery mechanism is disposed below the sub-compression mechanism.

4. The fluid machine according to claim 1, wherein the mechanical power recovery mechanism is disposed below the sub-compression mechanism, and the at least one heat-insulating structure includes:

a first heat-insulating structure disposed between the main compression mechanism and the sub-compression mechanism; and a second heat-insulating structure disposed between the sub-compression mechanism and the mechanical power recovery mechanism.

5. The fluid machine according to claim 1, wherein the at least one heat-isolating structure is constituted by a separate component from the mechanical power recovery mechanism and the sub-compression mechanism.

6. The fluid machine according to claim 1, wherein the oil can flow between the upper portion and the lower portion through a gap between an inner wall of the closed casing and the at least one heat-insulating structure.

7. The fluid machine according to claim 1, wherein the heat-insulating structure has an oil flow hole for communicating the upper portion and the lower portion.

8. The fluid machine according to claim 1, wherein the heat-insulating layer includes:

a plate portion disposed to separate the upper portion and the lower portion and having a communication hole for communicating the upper portion and the lower portion; and a tube portion extending from the plate portion toward the upper portion and having inside thereof a through hole communicating with the communication hole.

9. The fluid machine according to claim 8, wherein the upper portion and the lower portion are kept separated from each other by the heat-insulating structure.

10. The fluid machine according to claim 1, wherein the heat-insulating structure includes a plate member disposed to separate the upper portion and the lower portion and having a communication hole for communicating the upper portion and the lower portion, and the plate member has an interior space for spacing a surface portion of the plate member located on a side of the upper portion apart from a surface portion of the plate member located on a side the lower portion.

11. The fluid machine according to claim 10, wherein at least one of the surface portion located on the side of the upper portion and the surface portion located on the side of the lower portion has an opening for communicating the interior space and the oil reservoir.

12. The fluid machine according to claim 10, wherein the interior space faces an inner wall of the closed casing.

13. The fluid machine according to claim 1, wherein the heat-insulating structure includes:

a plate portion located at a position spaced apart from an inner wall of the closed casing between the upper portion and the lower portion; and a peripheral portion disposed between the plate portion and the inner wall of the closed casing so as to connect the plate portion and the inner wall of the closed casing, and the peripheral portion has an interior space including at least one of a first interior space and a second interior space, the first interior space extending above the plate portion toward the upper portion and facing the inner wall of the closed casing, and the second interior space extending below the plate portion toward the lower portion and facing the inner wall of the closed casing.

14. The fluid machine according to claim 13, wherein the plate portion has an interior space for spacing a surface portion of the plate portion located on a side of the upper portion apart from a surface portion of the plate portion located on a side of the lower portion.

15. The fluid machine according to claim 10, wherein the interior space is filled with the oil or the working fluid.

16. The fluid machine according to claim 1, further comprising a plate member disposed to partition the upper portion into a first upper portion located on a top surface portion of the oil reservoir and a second upper portion located below the first upper portion, the plate member having one or more communication holes for communicating the first upper portion and the second upper portion, wherein the rotation motor is disposed closer to the oil reservoir than the main compression mechanism.

17. The fluid machine according to claim 1, wherein the mechanical power recovery shaft has an oil supply passage opening at a lower end face of the mechanical power recovery shaft to supply the oil to the mechanical power recovery mechanism and the sub-compression mechanism.

18. The fluid machine according to claim 3, wherein the mechanical power recovery mechanism or the sub-compression mechanism is fixed to the closed casing.

19. The fluid machine according to claim 1, wherein the main compression mechanism is disposed above the oil reservoir, the main compression mechanism side shaft has a lower end portion reaching the upper portion, the fluid machine further comprises an oil pump disposed at the lower end portion of the main compression mechanism side shaft to pump up the oil in the upper portion, and the main compression mechanism side shaft has an oil supply passage for supplying the oil pumped up by the oil pump to the main compression mechanism.

20. The fluid machine according to claim 1, wherein the main compression mechanism is immersed in the upper portion.

21. The fluid machine according to claim 1, wherein the sub-compression mechanism compresses the working fluid by carrying out the suction process in which the working fluid is drawn and the discharge process in which the drawn working fluid is discharged, and at least one of the sub-compression mechanism and the mechanical power recovery mechanism is a fluid pressure motor in which the suction process and the discharge process are carried out in a substantially continuous manner.

22. The fluid machine according to claim 1, wherein the main compression mechanism discharges the compressed working fluid into the closed casing.

23. A refrigeration cycle apparatus comprising the fluid machine according to claim 1.

* * * * *